US008248341B2

(12) United States Patent
Neugebauer

(10) Patent No.: US 8,248,341 B2
(45) Date of Patent: Aug. 21, 2012

(54) LOW POWER ACTIVE MATRIX DISPLAY

(75) Inventor: Charles F. Neugebauer, Los Altos, CA (US)

(73) Assignee: Store Electronic Systems SA, Argenteuil (FR)

( * ) Notice: Subject to any disclaimer, the term of this patent is extended or adjusted under 35 U.S.C. 154(b) by 798 days.

(21) Appl. No.: 12/424,319

(22) Filed: Apr. 15, 2009

(65) Prior Publication Data

US 2010/0265168 A1 Oct. 21, 2010

(51) Int. Cl.
*G09G 3/36* (2006.01)

(52) U.S. Cl. ..... 345/87; 345/55; 345/94; 345/103

(58) Field of Classification Search ..... None
See application file for complete search history.

(56) References Cited

U.S. PATENT DOCUMENTS

| | | | | |
|---|---|---|---|---|
| 4,946,259 | A | 8/1990 | Matino et al. | |
| 6,836,266 | B2 * | 12/2004 | Kondo et al. | 345/103 |
| 7,760,181 | B2 * | 7/2010 | Nakamura | 345/100 |
| 8,120,551 | B2 * | 2/2012 | Yumoto | 345/76 |

FOREIGN PATENT DOCUMENTS

JP 60263122 A 12/1985

* cited by examiner

*Primary Examiner* — Muhammad N Edun
(74) *Attorney, Agent, or Firm* — Blakely, Sokoloff, Taylor & Zafman

(57) ABSTRACT

Described herein are systems and methods for the reduction of power consumption and mitigation of device stress accumulation in low frequency refreshed Liquid Crystal Displays (LCDs). In an exemplary embodiment, two or more transistors in series are used to hold charge on an LCD pixel. To prevent negative stress on the transistors, the transistors are alternately driven to an "on" state so that no one transistor sees a long "off" time. In another embodiment, circuits and signaling waveforms for performing frame writing and stress mitigation are provided that minimize dynamic power consumption and static power consumption in peripheral ESD circuits.

8 Claims, 21 Drawing Sheets

LOW POWER ACTIVE MATRIX DISPLAY

FIELD

The disclosure relates to low power active matrix displays.

BACKGROUND INFORMATION

Low power displays are essential system components of most mobile electronic devices. The display subsystem is often one of the largest consumers of battery power as well as one of the most expensive components in many of these devices. The display industry has made continuous progress improving the visual performance, power consumption and cost through device and system architecture innovations. However, there is a class of important applications that require additional significant improvements in power and cost to become technically and financially viable.

The dominant display technology for mobile devices, computer monitors and flat panel TVs is currently amorphous silicon hydrogenated thin film transistor (a-Si:H TFT) liquid crystal, also known generally as active matrix LCD technology. Advanced manufacturing technologies support a highly efficient worldwide production engine with capacity of over 100 million square meters of flat panel displays per year. The most common display architecture in this technology consists of a simple array of TFT pixels on a glass panel that are driven by one or more driver ICs.

One significant barrier to building displays in a-Si:H TFT processes is the poor performance and long term reliability of the a-Si:H TFT devices. Compared to single-grain silicon CMOS technology a-Si TFTs have very low electrical mobility which limits the speed and drive capability of the transistors on the glass. Additionally, the a-Si TFT transistors can accumulate large threshold voltage shifts and subthreshold slope degradations over time and can only meet product lifetime requirements by imposing strict constraints on the on-off duty cycle and bias voltages of the transistors. "Electrical Instability of Hydrogenated Amorphous Silicon Thin-Film Transistors for Active-Matrix Liquid-Crystal Displays" and "Effect of Temperature and Illumination on the Instability of a-Si:H Thin-Film Transistors under AC Gate Bias Stress" give a good overview of the gate bias stress induced threshold shifts and subthreshold slope degradations seen in a-Si:H TFTs.

The positive and negative stress accumulation processes have very different accumulation rates and sensitivities to gate drive waveforms. To first order within the range of driving waveforms used in typical flat panel refresh circuitry, the accumulation of positive stress is not strongly dependent on the frequency content of the gate waveform and accumulates relatively rapidly as a function of the integrated "on" time and voltage of a given gate. As positive stress is applied the voltage threshold of the TFT device is typically increased. TFT circuits typically have a maximum allowable positive threshold shift beyond which the desired device functionality ceases.

Negative stress accumulation, in contrast, depends strongly on frequency in the range of frequencies normally used in flat panel displays, accumulating more slowly at higher frequencies. Negative stress accumulation typically manifests as both negative threshold shift and subthreshold slope degradation. For negative stress to have a significant affect, the gate of a typical a-Si TFT needs an unbroken stretch of negative bias (e.g. 100 ms or more for typical a-Si:H TFT devices). In conventionally scanned TFT flat panel displays, the gate voltage is positive only for a very small time (e.g. one line time, about 15 us every 16.600 ms frame; about 0.1% duty cycle) and negative for the rest of the frame period (e.g. 16.585 ms or about 99.9% of the frame period). Were it not for the strong frequency dependence of the negative stress, conventional 60 Hz panel drive would have a very short operational lifetime as negative stress accumulation would quickly render the display non-functional.

One of the key techniques to minimize system power of electronic systems is to limit or reduce the operation frequency. Power dissipation is often nearly proportional to refresh frequency in typical TFT LCD displays. In some applications where the displayed content does not require a fast optical response (e.g. slowly updated or static information) the power dissipation of a TFT LCD can be reduced significantly by driving the frame refresh at e.g. 1 Hz vs. a conventionally scanned 60 Hz. Such a reduction, while favorable for power, is problematic for the device. First, the optical quality of the display is compromised; at low frame rates the display can flicker significantly. Second, at low frame rates the negative stress accumulation of the pixel TFTs occurs much more rapidly than at 60 Hz and will quickly degrade the functionality of the display. As a result, while frame rate reduction from 60 Hz to 30 Hz or even 20 Hz has been used as a power reduction technique, TFT device reliability limits prevent further frame rate reductions in conventional displays. The display described herein addresses these limitations.

There are display applications where battery life of months or years is desired if not required e.g. electronic books, signs and price labels. A large set of new display technologies has been developed to address such markets that require little or no power between displayed content changes. Such displays are often referred to as electronic paper or bi-stable displays. This class of displays is primarily used in a reflective mode to minimize power. For devices whose primary utility is based on the display of information (e.g. mobile email, e-books, marketing messages) such utility is enhanced by display technologies that allow longer active display times between battery recharges or changes. The display described herein is directed to such applications.

SUMMARY

A display system that substantially prevents negative stress accumulation in low frame frequency refreshed TFT displays is disclosed.

A display system that substantially lowers power in low frame frequency refreshed TFT displays is disclosed.

A display system that minimizes power and prevents negative stress accumulation through temporal and amplitude modulation of the drive waveforms is also disclosed.

A display system that substantially lowers power in low frame frequency refreshed TFT displays using an external driver IC is disclosed.

Further objects, aspects, and advantages of the present teachings will be readily understood after reading the following description with reference to the drawings and the appended claims.

GLOSSARY OF TERMS

The following abbreviations are utilized in the following description, which abbreviations are intended to have the meanings provided as follows:

a-Si—amorphous silicon
AC—alternating current
CMOS—complementary MOS (both P and N type FETs available)
COM—common electrode in an LCD device
DC—direct current
ECB—electrically controlled birefringence
ESD—electro static discharge
ESL—electronic shelf label
FET—field effect transistor
IC—integrated circuit
$I_{DS}$—drain to source current
LCD—liquid crystal display
MOS—metal oxide semiconductor
MTN—mixed-mode twisted nematic
NMOS—N-channel MOS
OCB—optically compensated bend
PDLC—polymer dispersed liquid crystal
RGB—red, green, blue
RGBW—red, green, blue, white
RMS—root mean square
RTN—reflective twisted nematic
TFT—thin film transistor
$V_{GS}$—gate-source voltage

DETAILED DESCRIPTION

Each of the additional features and teachings disclosed below may be utilized separately or in conjunction with other features and teachings to provide improved low power displays and methods for designing and using the same. Representative examples, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the claims. Therefore, combinations of features and steps disclosed in the following detail description may not be necessary to practice the concepts described herein in the broadest sense, and are instead taught merely to particularly describe representative examples of the present teachings.

In addition, it is expressly noted that all features disclosed in the description are intended to be disclosed separately and independently from each other for the purpose of original disclosure, as well as for the purpose of restricting the subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

Figure 1:
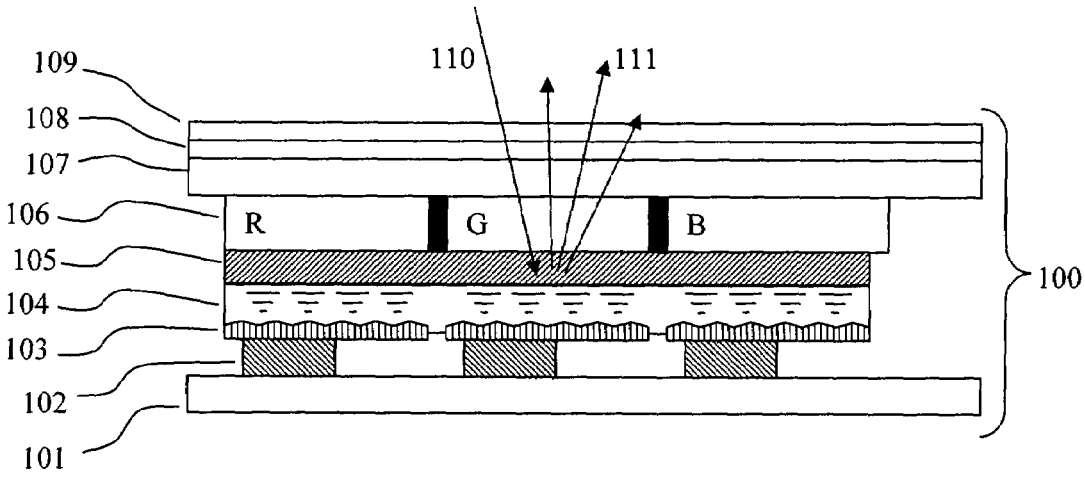
(PRIOR ART) Figure 1.
FIG. 1 shows a representative prior art reflective TFT LCD cross section.

FIG. 1 shows a simplified cross section of a reflective single polarizer TFT LCD flat panel display 100. The control circuitry 102 is fabricated on a substrate 101. Control circuitry 102 may be implemented preferably in an amorphous-Si process but can alternatively be implemented with any thin-film switch-capable backplane technology, i.e. any inorganic or organic semiconductor technology. Substrate 101 can be glass, plastic, quartz, metal, or any other substrate capable of supporting switching device fabrication. Electrode 103 can be formed by photolithographic, embossing, printing and/or chemical processes and can be textured to diffusely reflect incident light. Liquid crystal display material 104 sits in between the top and bottom plates. Color filters 106 and a top plate transparent conductor 105 driven by a voltage conventionally labeled "COM" (for "common") are deposited on the top substrate 107. A retardation film or quarter wave plate 108 can be placed on top of the upper substrate 107. A diffusing polarizer 109 completes the LCD stack 100. In typical operation incident light 110 is polarized, filtered and diffusely reflected by the LCD stack 100 to create a reflected image 111.

Alternative display materials and constructions other than that shown in FIG. 1, such as those with a flat reflector layer, a dual polarizer reflective with a reflector outside the lower glass substrate, transmissive, transflective, backlit, sidelit, frontlit, guest host LCD, electrically controlled birefringent, RTN, MTN, ECB, OCB, PDLC, electrophoretic, liquid powder, MEMs, electrochromic, or other alternate electrically controlled display technologies that require an active backplane can benefit from the present teachings. The specific description herein of a reflective LCD incorporating the present teachings does not limit the scope of the present teachings in their application to alternative display materials and technologies.

Figure 2:
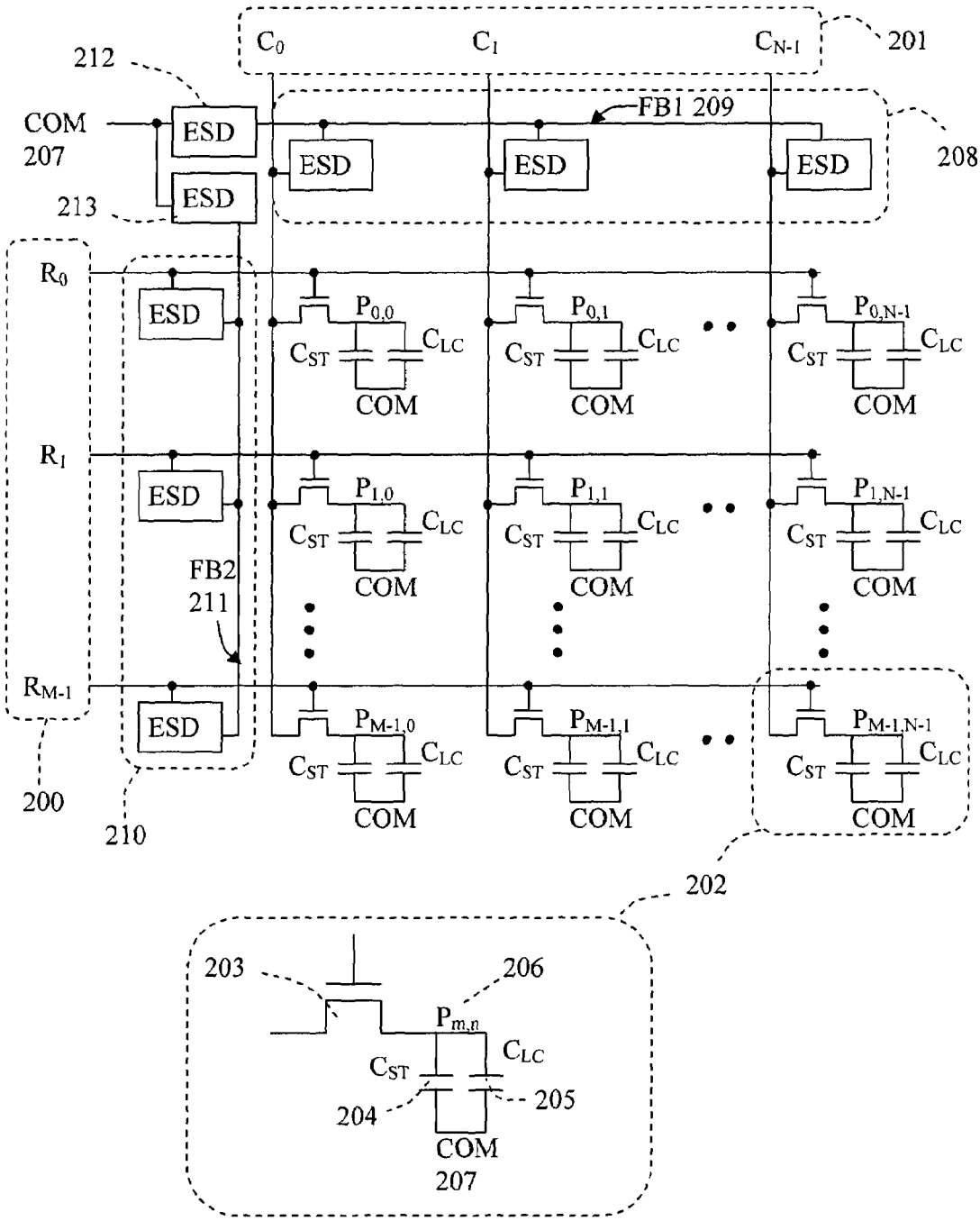
(PRIOR ART) Figure 2.
FIG. 2 shows a representative circuit diagram for a prior art TFT LCD array.

FIG. 2 shows a typical circuit diagram of a conventionally scanned prior art TFT display. At each intersection of a row gate line $R_0$ to $R_{M-1}$ 200 and a column source line $C_0$ to $C_{N-1}$ 201 is a TFT pixel 202 which consists of a single TFT transistor 203, a storage capacitor $C_{ST}$ 204 and a liquid crystal capacitor $C_{LC}$ 205 formed between the reflective electrode $P_{m,n}$ 103 206 and the common (COM) counter glass electrode 107 207. Row lines $R_m$ 200 are typically driven to sequentially pulse "on" each row of TFT transistors which captures the voltages driven on the column lines $C_n$ 201 into the array of pixel storage $C_{ST}$ 204 and LCD capacitors $C_{LC}$ 205 to form an array of pixel voltages $P_{m,n}$ 206 and a corresponding image.

In FIGS. 1 and 2, each electrical connection to the TFT substrate 101 is protected against electrostatic discharges with an ESD protection device. The column line ESD devices 208 are attached to a first floating bar, FB1 209, and the row line ESD devices 210 are attached to a second floating bar, FB2 211. The two floating bars FB1 209 and FB2 211 are subsequently connected to the COM electrode 207 with two additional ESD devices, 212 and 213 respectively. Those skilled in the art will recognize that the ESD protection scheme shown in FIG. 2 is one of many possible ESD protection schemes in common use. For very low power displays, ESD circuits are typically a major consumer of static power in the active devices on the display substrate 101.

Figure 3:
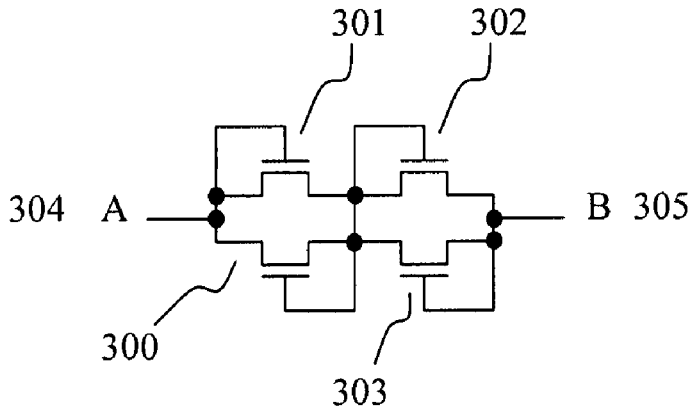
(PRIOR ART) Figure 3.
FIG. 3 shows a representative prior art ESD circuit element and its associated nonlinear I-V transfer curve.
Figure 3:
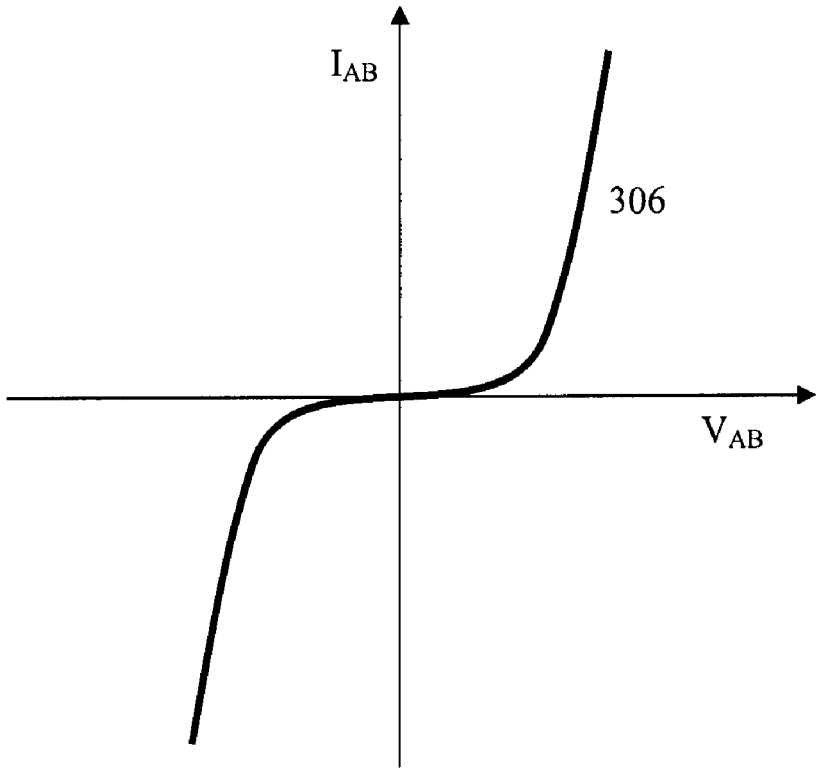
(PRIOR ART) Figure 3.

FIG. 3 shows a typical four TFT ESD protection device commonly used in flat panel displays. It consists of four diode connected transistors 300 301 302 303, half of which will be forward biased when the voltage across the two terminals A 304 and B 305 is highly positive or negative. For low voltage operation the current is close to zero as shown in the associated I-V curve 306. To minimize leakage power in ESD devices, typically the voltage waveforms applied to the TFT substrate 101 should be kept at a voltage as close to that of COM 207 as possible while maintaining the desired operation. Those skilled in the art recognize the wide variety of TFT ESD protection sub circuits available; for the purposes of the present teachings any device or combination of devices that have nonlinearly increasing current as a function of applied absolute voltage can be substituted without limitation.

Liquid crystals are commonly driven with AC pixel voltage signals that invert polarity at the display's frame rate. Such bipolar drive is commonly necessary to prevent damage to the liquid crystal that can occur if significant DC voltages (e.g. a few volts or more) are applied for a significant period of time (e.g. tens of seconds or more). Such damage often accumulates over the life of the panel and can lead to image burn-in, image sticking, loss of contrast or other visible defects. Typical LCD materials are designed to respond approximately to the RMS of the AC signal over a wide range of frequencies.

To achieve AC pixel drive several techniques are commonly used. The simplest and lowest power is frame inversion wherein all of the pixels in the frame are first written with a positive polarity frame followed by an entirely negative polarity frame. Often the COM counter electrode that forms the back plate of the storage capacitor $C_{ST}$ and the LC capacitor $C_{LC}$ is modulated from the positive frame to the negative frame to reduce the voltage range of the column source driver IC, saving power and cost. Despite the simplicity and power/cost advantages, frame modulation can lead to noticeable flicker if the two frames (positive and negative) are not balanced well.

To mitigate the flicker effect from unbalanced frame inversion, the COM counter electrode can be modulated on a per line (or multiline) basis during the frame scanning process. This maintains the low voltage range of the column source drivers while incurring higher power to drive COM as the COM electrode is highly capacitive. For a given amount of imbalance between positive and negative pixel drive the line inversion technique generates less visible flicker as the two polarities are typically tightly interleaved spatially (e.g. even and odd lines are alternating polarity). An additional level of positive and negative pixel interleaving (both horizontally and vertically on the display) called dot-inversion is generally regarded as the best visually for a given imbalance but also has the highest power consumption and requires higher voltage range column driver ICs compared to the line or frame inversion techniques.

Drive waveforms for displays can be described and synthesized in many forms; in what follows, for simplicity and clarity, a simple multi-level drive waveform description is generally used that facilitates the exposition of the present teachings. Signal names beginning with the letter "V" are generally used herein to indicate a DC voltage level that can be used for multi-level waveform synthesis (e.g. by using a switch or mux). Those skilled in the art will recognize the wide variety of waveform description and synthesis methods (e.g. analog waveforms, buffer amplifiers, etc.); the present teachings are applicable to the many available waveform descriptions, synthesis methods and hardware implementations thereof.

Figure 4:
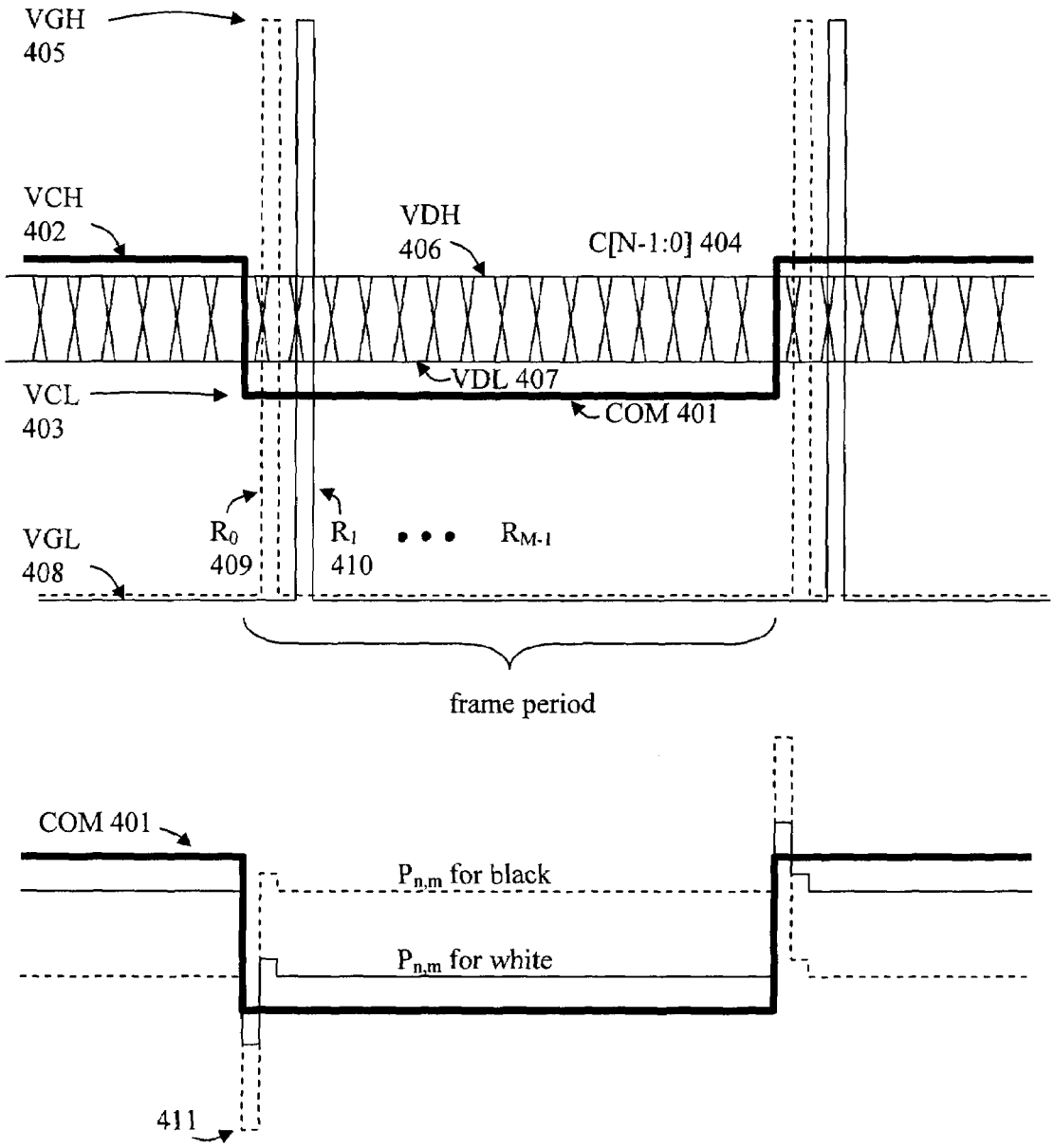
(PRIOR ART) Figure 4.
FIG. 4 shows a representative set of voltage waveforms for a prior art frame inversion drive method of the prior art TFT circuit in FIG. 2.

FIG. 4 shows a typical set of drive waveforms for the conventionally scanned prior art TFT display of FIG. 2 using the COM modulation technique for frame inversion. Depending on the desired polarity of the frame, the COM node 401 is driven to one of two DC levels VCH 402 or VCL 403. For a TFT technology with a threshold voltage near zero, a selected row line must be driven well above the desired pixel voltages $P_{m,n}$ 206 to create conduction in the pixel TFT 203. Column source lines C[N-1:0] 404 (notation for the set of lines $C_0$ to $C_{N-1}$) are driven with the desired pixel voltages for a given row of pixels while the corresponding row gate voltage is pulsed to a high gate voltage VGH 405. For the present example, a bi-level column drive waveform using two DC data voltages, VDH 406 and VDL 407 will be used to simplify the description and drawings. As is well known in the art the column lines can be driven with analog voltages between VDH 406 and VDL 407 to create a grayscale response in the LCD material 104. The present teachings can be generally applied to binary, multilevel and/or continuous analog column line drive.

Column source lines C[N-1:0] 404 thus set the voltage on the desired row of pixel storage capacitors 204. Subsequent rows of pixels are refreshed by sequentially driving all of the row gate electrodes high to VGH 405 then low to VGL 408 (e.g. R0 409 and R1 410 in FIG. 4) until the complete array of pixels is written. For frame inversion TFT LCDs, the aforementioned DC voltage levels obey the following relationship: VGH>VCH>VDH>VDL>VCL>VGL. Note that VGL typically needs to be negative enough to keep pixel TFT 203 in the "off" state despite the negative shift in the pixel voltage (Pn, m, especially for black, e.g. point 411 of FIG. 4) when the COM 401 node transitions low to level VCL 403.

Non-zero gate bias of N-type a-Si:H TFT devices is typically required to both activate and deactivate the devices. Positive gate bias in such devices turns the device "on" and typically induces a positive shift in the threshold voltage of the device over long time scales. Negative gate bias turns the device "off" and typically induces both a negative threshold shift and subthreshold slope reduction over long time scales.

Stress accumulation in a-Si:H TFTs is generally thought to follow a stretched exponential of the form:

$$\Delta V_T(t_{ST})=\Delta V_T^+(t_{ST})+\Delta V_T^-(t_{ST})$$

where the positive stress component:

$$\Delta V_T^+(t_{ST})=A_+V_{G+}^{\alpha+}(t_{ST}*D)^{\beta+}$$

and the negative stress component:

$$\Delta V_T^-(t_{ST})=A_-V_{G-}^{\alpha-}(t_{ST}*(1-D))^{\beta-}F_{PW}$$

act relatively independently; where $\Delta V_T$ is the threshold shift, $V_G$ is the gate bias less the threshold voltage of the device, $t_{ST}$ is the total stress time, A is an empirical constant, D is the duty cycle of the positive part of the drive signal and $F_{PW}$ is a factor between zero and one indicating the negative stress accumulation frequency dependence. Generally the stress induced threshold shift is proportional to the gate drive amplitude ($V_{GS}-V_T$) raised to a power around 1.5 to 2.0 and approximately the square root of the total stress time accounting for duty cycle (e.g. $\alpha+/-\sim=1.7$ and $\beta+/-\sim=0.4$). Due to the approximately square law dependence on voltage, a short duration high amplitude gate drive signal can generate significantly more stress than a lower gate voltage applied over a longer period of time; in a preferred embodiment, the gate drive amplitudes are minimized and charging time and TFT size are maximized to lower the required $V_{GS}$ gate drive and minimize TFT stress.

Figure 5:
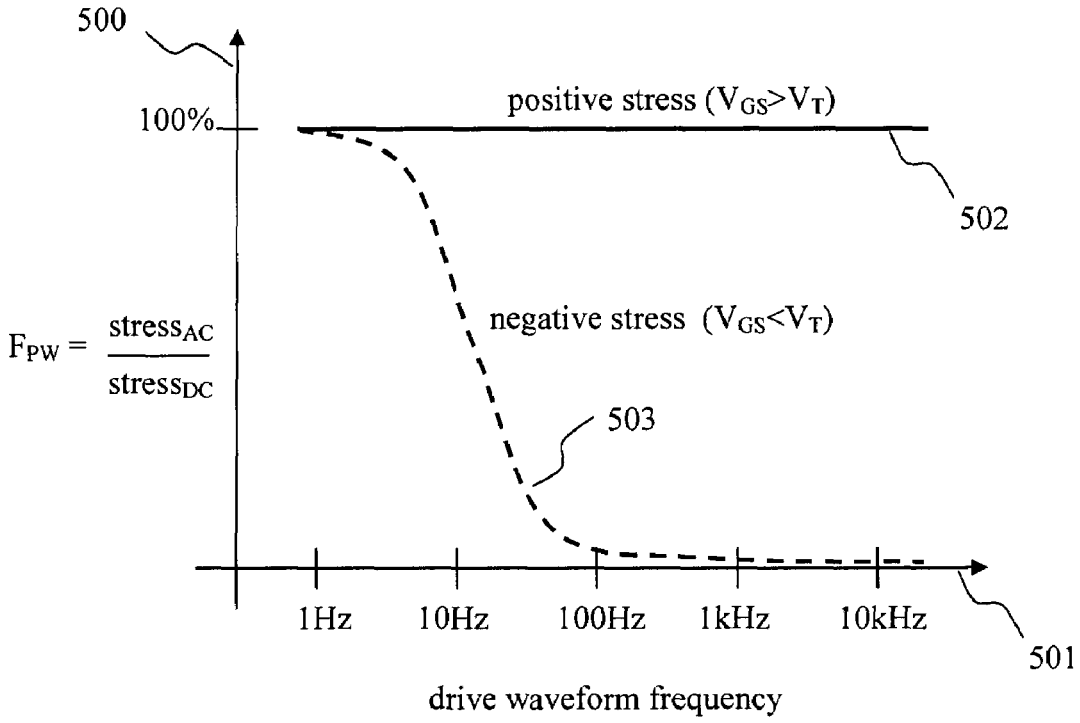
(PRIOR ART) Figure 5.
FIG. 5 shows a representative prior art variation in the frequency response of positive and negative gate bias stress accumulation of a-Si:H TFTs.

FIG. 5 shows a representative relationship between the drive waveform frequency 501 and the accumulation of positive and negative AC stress relative to the accumulation of DC stress 500 (effectively the $F_{PW}$ factor for negative stress) typical of a-Si:H TFTs. Typically the positive stress 502 is independent of a wide range of typical gate signal frequencies whereas the negative stress 503 is highly dependent on frequencies of interest to low power refresh operation. For conventionally scanned TFT LCD displays, the frame rate is relatively high (e.g. 60 Hz) compared to the characteristic cutoff frequency in negative stress; as a result the negative stress is substantially reduced relative to its DC value. This reduction is in fact absolutely necessary since the negative stress has nearly 100% duty cycle in a conventional driving scheme and without negative gate bias AC modulation such displays would fail rapidly (days or weeks).

Negative and positive stress accumulation mechanisms are theorized to be affected very strongly by the density of charges (holes and/or electrons) in the TFT channel. When a gate is biased with a positive $V_{GS}$, electrons are available immediately from the source and/or drain and very rapidly fill the channel. Due to the rapid charging of the channel, the positive stress exhibits very little frequency rolloff in the range of interest for displays (below 100 kHz).

Negative bias, however, depletes the channel of electrons and forms a potential well for holes. Holes, however, due to their limited mobility and the lack of a source in an NMOS device, accumulate much more slowly than electrons in the TFT channel. The slow rate of hole generation and accumulation in the channel is the basis for the rapid dropoff in accumulated stress as the frequency of the gate modulation is increased. By periodically pulsing the gate voltage to a positive level, holes that have accumulated are either injected into the source or drain or recombine with incoming electrons. In either case, a short, slightly positive $V_{GS}$ clears the holes from the channel and neutralizes the negative stress mechanism.

Flat panel display power can be broken down into two main categories: dynamic power which is more or less proportional to the frame frequency and static power which is relatively independent of frame frequency.

In order to reduce the dynamic power dissipation of a flat panel display, the frame rate is desirably reduced. However for conventionally scanned displays lower frame frequency results in lower negative stress frequency which increases the effect of the negative stress to the point where the lifetime of the flat panel can be substantially shortened. The present teachings describe a circuit technique that mitigates such negative stress at very low frame rates (e.g. 1 Hz) to achieve very low power refreshed displays. In addition, the present teachings detail a technique wherein the dynamic power dissipation can be concentrated on a few line drivers of a driver IC so that charge sharing or adiabatic charging methods can be used to further reduce power.

ESD circuits of a conventionally scanned display often consume negligible power compared to the driver ICs and backlight. However for reflective flat panel displays driven at very low frame rates (e.g. 1 Hz) the power consumed by the ESD protection devices can become a significant fraction of the total power consumption. In order to reduce the static power dissipation of a low frame rate flat panel display, the ESD circuit power dissipation is desirably reduced. A trivial method, reducing the size of the ESD devices, has the undesirable side effect of reducing the protection against static discharge afforded by such ESD devices. The present teachings describe circuits and driving methods that minimize power consumption in standard ESD protection devices for very low frame rate displays.

Figure 6:
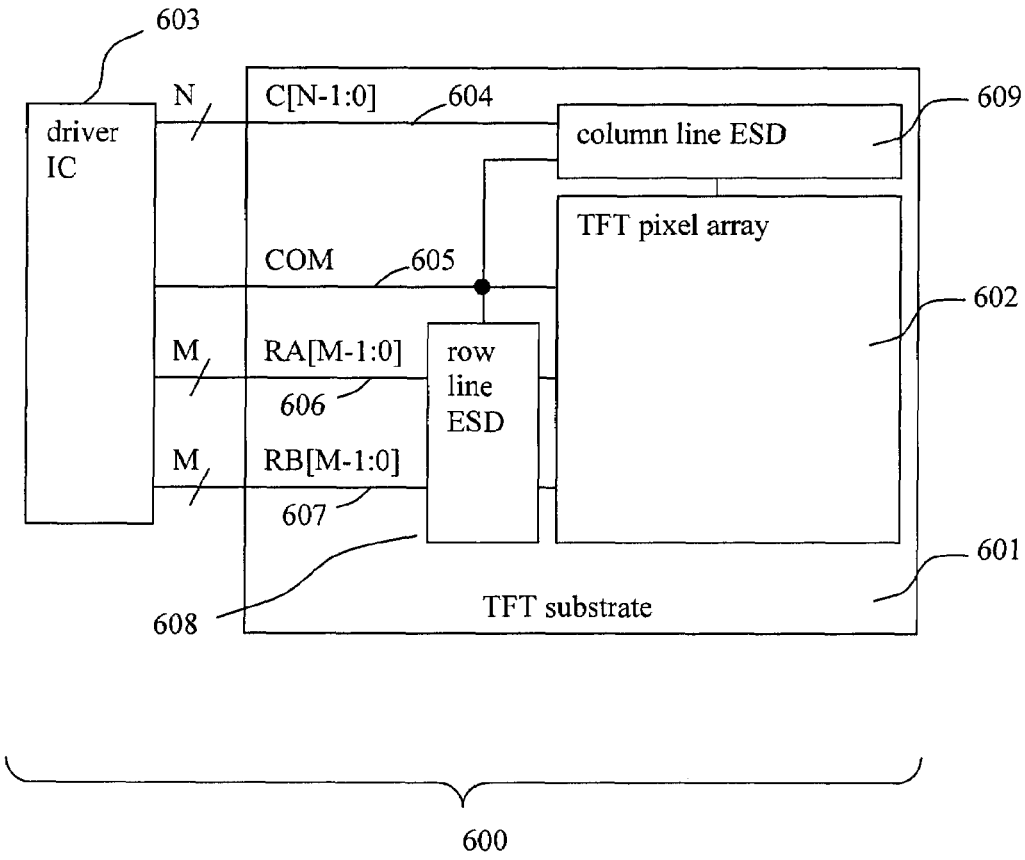
FIG. 6 shows a representative block diagram of a TFT LCD electrical system with an external row and column driver IC.

FIG. 6 shows a block diagram of the electrical drive system of the flat panel display 600 of a preferred embodiment of the present teachings. TFT substrate 601 incorporates a TFT pixel array 602, row ESD devices 608, column ESD devices 609, row lines RA[M-1:0] 606 and RB[M-1:0] 607, column lines C[N-1:0] 604, a COM line 605 and a driver IC 603. Column and/or row driver functions can be performed by any combination of IC and/or integrated a-Si TFT circuits; the present teachings can be applied to such modifications, selections and combinations with full generality.

Figure 7:
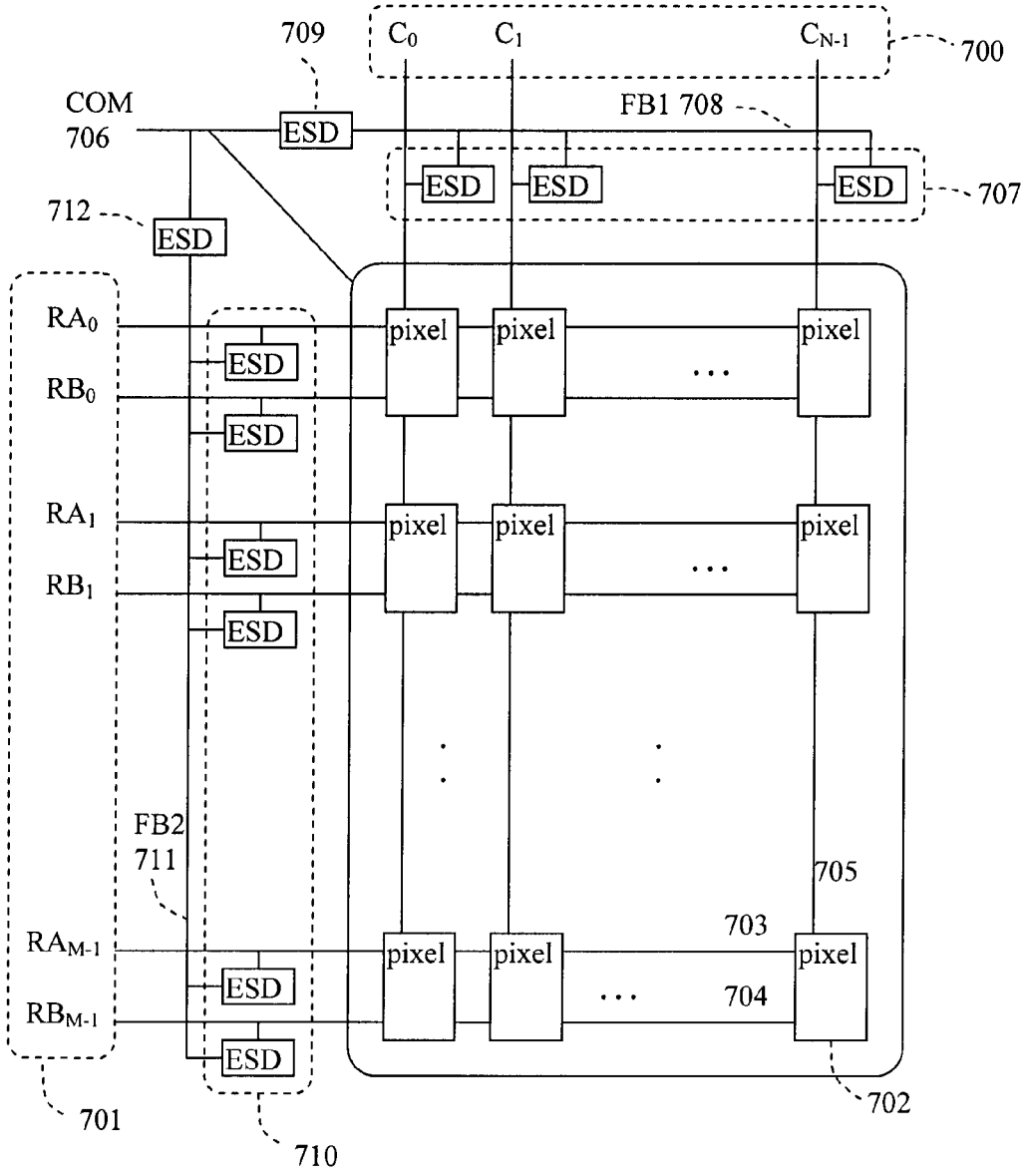
FIG. 7 shows a representative circuit diagram of the TFT portion of an LCD.

FIG. 7 shows an electrical diagram of the TFT pixel array for an example display with N columns by M rows of pixels. In what follows the TFT devices are assumed to have a threshold voltage of zero for the sake of simplifying the description. Those skilled in the art will recognize that non-zero threshold voltages are easily accommodated by offsetting the gate and control voltages described herein. The present teachings are easily generalized for non-zero threshold voltages by those skilled in the art; such generalizations are considered within the scope of the present teachings.

In FIG. 7, pins C[N-1:0] 700 supply the source voltages that are driven into the pixel array. Row select signals RA[M-1:0] and RB[M-1:0] 701 are used to drive the gates of the array of pixels. Each pixel (e.g. 702) is connected to a first row line RA 703, a second row line RB 704, a column line C 705 and COM 706. Each pixel contains circuitry to control the LCD pixel voltage $P_{m,n}$ as well as counteract bias stress on the pixel's TFTs. Column ESD devices 707 are connected to a first floating bar, FB1 708, which is also connected to the COM electrode 706 through another ESD device 709. Row ESD devices 710 are connected to a second floating bar, FB2 711, which is also connected to COM through another ESD device 712.

Figure 8:
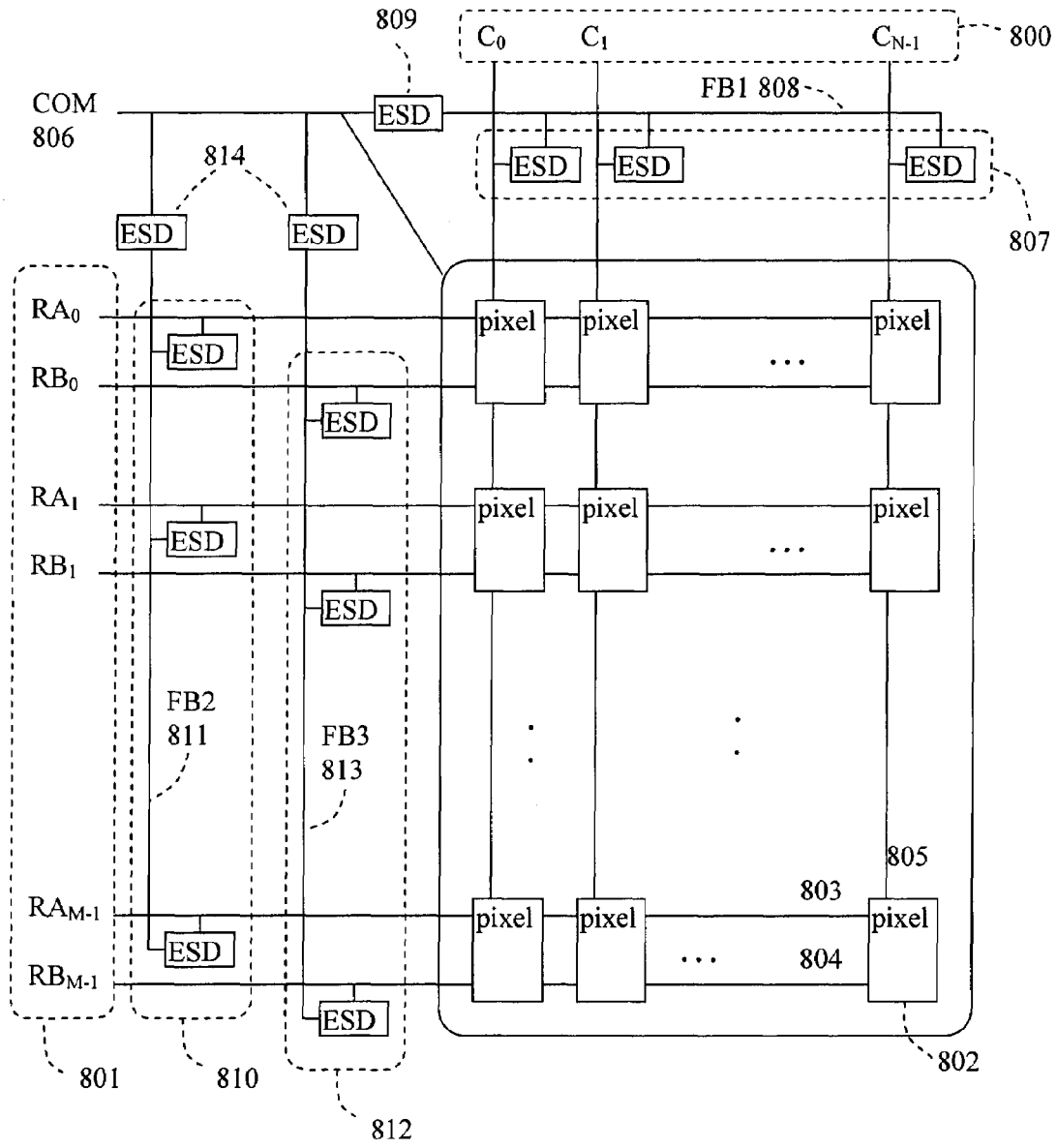
FIG. 8 shows a representative circuit diagram of an alternative implementation of the TFT portion of an LCD.

FIG. 8 shows an alternative preferred embodiment of the present teachings. Similar to FIG. 7, the embodiment shown in FIG. 8 contains a set of N column lines C[N-1:0] 800 and two sets of row signals with M lines in each set RA[M-1:0] and RB[M-1:0] 801 driving an array of pixels, each pixel (e.g. 802) being connected to an RA signal 803, an RB signal 804, a C column line 805 and the COM electrode 806. Column signals C[N-1:0] 800 are also connected via ESD circuits 807 to a first floating bar FB1 808 which is also connected to COM 806 through an additional ESD device 809. In contrast with the circuit of FIG. 7, the row ESD devices are split into two groups; the RA[M-1:0] signals are connected with a first set of row ESD devices 810 to a first row floating bar, FB2 811, and the RB [M-1:0] signals are connected with a second set of row ESD devices 812 to a second row floating bar, FB3 813. Both FB2 and FB3 are connected with additional ESD devices 814 to COM to provide a discharge path. In this embodiment, the leakage power expended in the row ESD devices 810 812 is reduced during operations described below.

Figure 9:
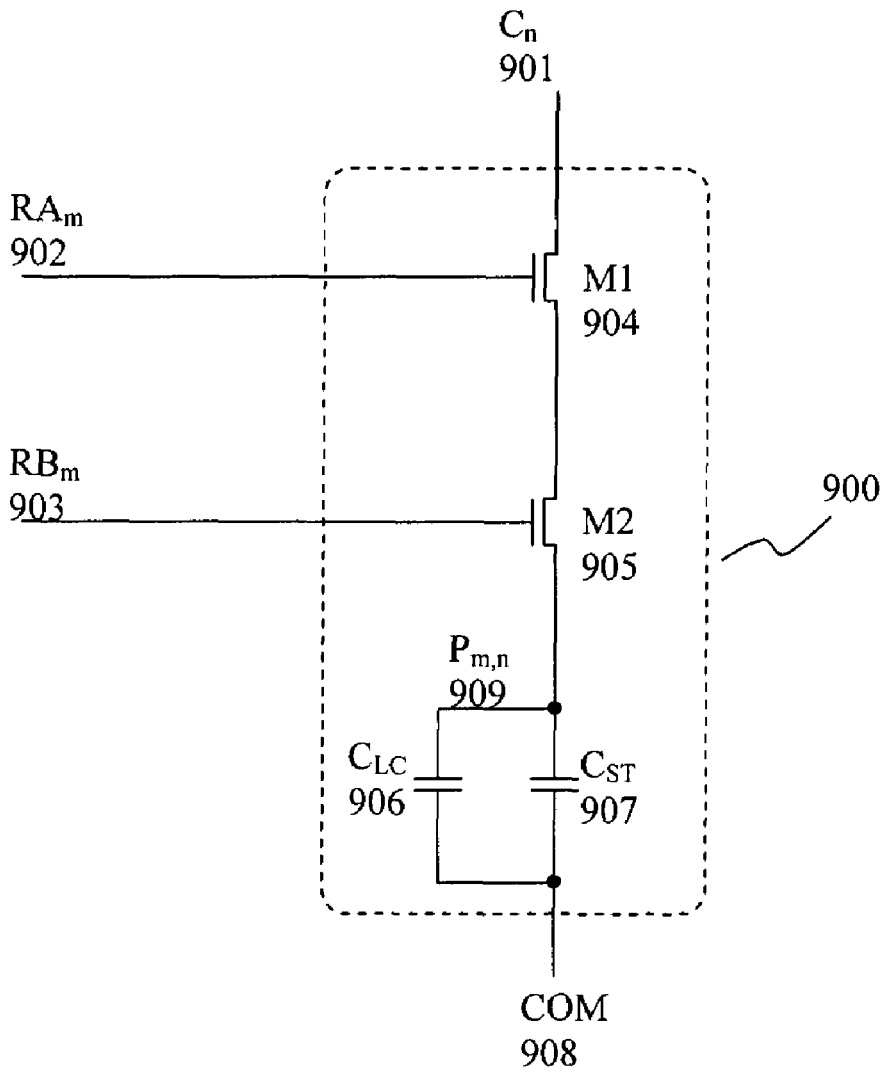
FIG. 9 shows a representative TFT pixel circuit schematic.

FIG. 9 shows a preferred embodiment of a TFT pixel circuit 900 according to the present teachings comprising a column line $C_n$ 901 connected to the source of a first pass transistor M1 904, a first row line $RA_m$ 902 which is connected to the gate of the first series pass transistor M1 904, a second pass transistor M2 905 whose source is connected to the drain of M1 904 and whose gate is connected to a second row line $RB_m$ 903, a liquid crystal cell capacitance $C_{LC}$ 906 connected to the drain of the second pass transistor M2 905, a storage capacitor $C_{ST}$ 907 connected to the drain of the second pass transistor M2 905 and a common line COM 908 connected to the storage capacitor $C_{ST}$ 907 and the liquid crystal capacitance $C_{LC}$ 906. The two pass transistors M1 904 and M2 905 are connected in series to form a gated conduction path from $C_n$ 901 to $P_{m,n}$ 909, the pixel control node. Charge storage capacitors $C_{ST}$ 907 and $C_{LC}$ 906 connect $P_{m,n}$ 909 to COM 908 and hold the pixel control voltage when M1 904 or M2 905 are in the "off" state.

The pixel voltage $P_{m,n}$ 909 is written to the cell by first holding the COM line 908 in a high or low state and driving a voltage on the column line $C_n$ 901 which is connected to the source of M1 904. M1 904 is activated by pulsing its gate, $RA_m$ 902, to a high potential while simultaneously pulsing the gate of M2 905, $RB_m$ 903, to a high potential to increase the electrical conduction from $C_n$ 901 to $P_{m,n}$ 909 through the series connection of M1 904 and M2 905. Electrical charge is consequently loaded on or written into the $P_{m,n}$ 909 node and subsequently can be isolated from leaking away by maintaining at least one of the row gate lines $RA_m$ 902 or $RB_m$ 903 at a negative potential. The pixel charge is stored relative to COM 908 on both $C_{ST}$ 907 and $C_{LC}$ 906 capacitors.

Figure 10:
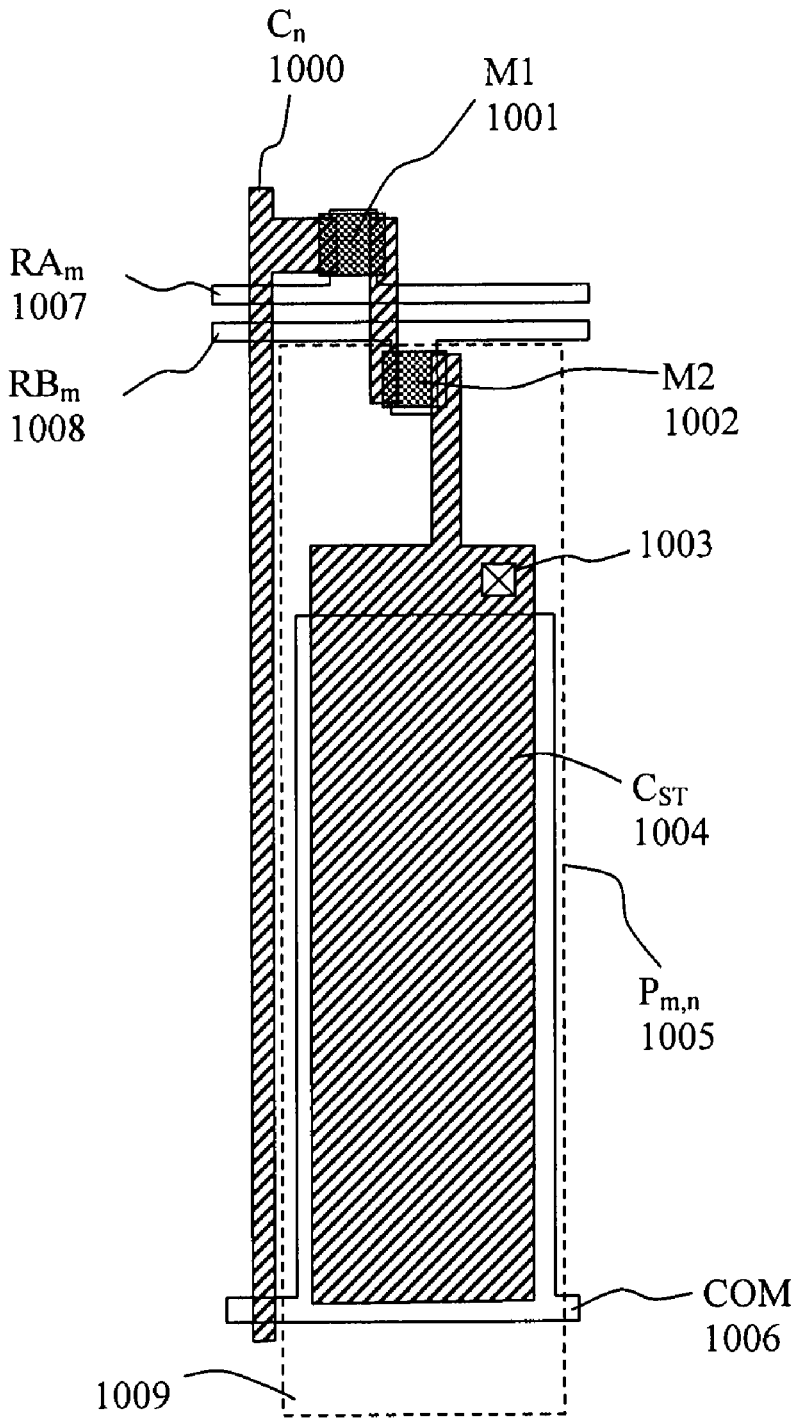
FIG. 10 shows a representative TFT pixel circuit layout.

FIG. 10 shows an embodiment of the layout of the pixel circuit shown in FIG. 9. A column line $C_n$ 901 1000 preferably made of deposited metal runs vertically through the pixel cell and is connected to the source of transistor M1 904 1001. The gate of M1 904 1001 is connected to the $RA_m$ electrode 902 1007. The drain of M1 904 1001 is connected to the source of M2 905 1002. The gate of M2 905 1002 is connected to gate electrode $RB_m$ 903 1008. The drain of M2 905 1002 is connected to the pixel storage node $P_{m,n}$ 909 1005 which is also connected to a storage capacitor $C_{ST}$ 907 1004 and to the reflective electrode plate 1009 through contact 1003 which forms one part of the LC cell capacitance $C_{LC}$ 906. The storage capacitor $C_{ST}$ 907 1004 is connected to the common back plate voltage COM 908 1006. The opposing electrode on the top glass (not shown) forms the other plate of $C_{LC}$ 906 and is electrically attached to the common electrode COM 908 1006.

Referring back to FIG. 9, the RMS difference in voltage between $P_{m,n}$ 909 and COM 908 determines the optical state of the liquid crystal. In one embodiment, the COM node 908 is modulated continuously to reduce the required voltage range of the TFT devices 904 905 and/or reduce power.

The two select TFTs M1 904 and M2 905 are gated by two independent row gate signals $RA_m$ 902 and $RB_m$ 903 respectively. The choice of two gates is for illustration purposes only; in practice the number of row select TFTs will be a design choice based on the TFT process parameters, the size and resolution of the display, the desired frame rate, the allowable flicker and other performance criteria. In the present embodiment, two or more row transfer TFTs are required to prevent negative stress accumulation at very low frame rates as described below. Such choices are considered within the scope of the present teachings.

Those skilled in the art will recognize that the concepts described herein may be applied to other TFT processes with different design rules and layers; the choice of process exhibited in FIG. 10 is for illustration purposes and is not a limitation of the present teachings. Also, the layout of FIG. 10 has many permutations, transpositions, reorientations, flips, rotations and combinations thereof that do not substantially modify the electrical behavior of the circuit and are considered within the scope of the present teachings. The present teachings can be modified to route the column and row lines through or around the cell in many different ways that do not alter the electrical connectivity or operation of the pixel circuit. Additionally, the arrangement of the storage capacitor (shown below the pass transistors in FIG. 10) can be varied to accommodate any number of configuration requirements and manufacturing requirements. The transistors M1 904 and M2 905 may be divided into subunits while maintaining the function of the concepts described herein. The storage capacitor $C_{ST}$ 907 may also be divided into multiple sections while maintaining the electrical purpose as described in the present teachings. Based on the present teachings, advantageous layout configurations of the equivalent circuit that minimize crosstalk, improve image quality, adjust storage capacitance, reduce power, improve stability, improve manufacturability and modify performance of the device based on the particular TFT process and application requirements will become evident to those skilled in the art and are considered within the scope of the concepts described herein.

In a preferred embodiment, an RGB stripe configuration is adopted, although the present teachings can be generally applied to any pixel or sub pixel arrangement, including without limitation RGB delta configurations, 2×2 RGBW configurations and any other subpixel arrangements or pixel arrangements as are well known in the art. Such modifications to the layout and circuit schematic are commonly done to meet application requirements and are considered within the scope of the present teachings.

The operation of this embodiment of a flat panel can be described as consisting of two phases. In practice the two phases can be interleaved, but for clarity they are described herein as distinct phases. The first phase involves writing a new frame of information to the pixel array. To accomplish this, a sequence of operations is performed on the array.

Figure 11:
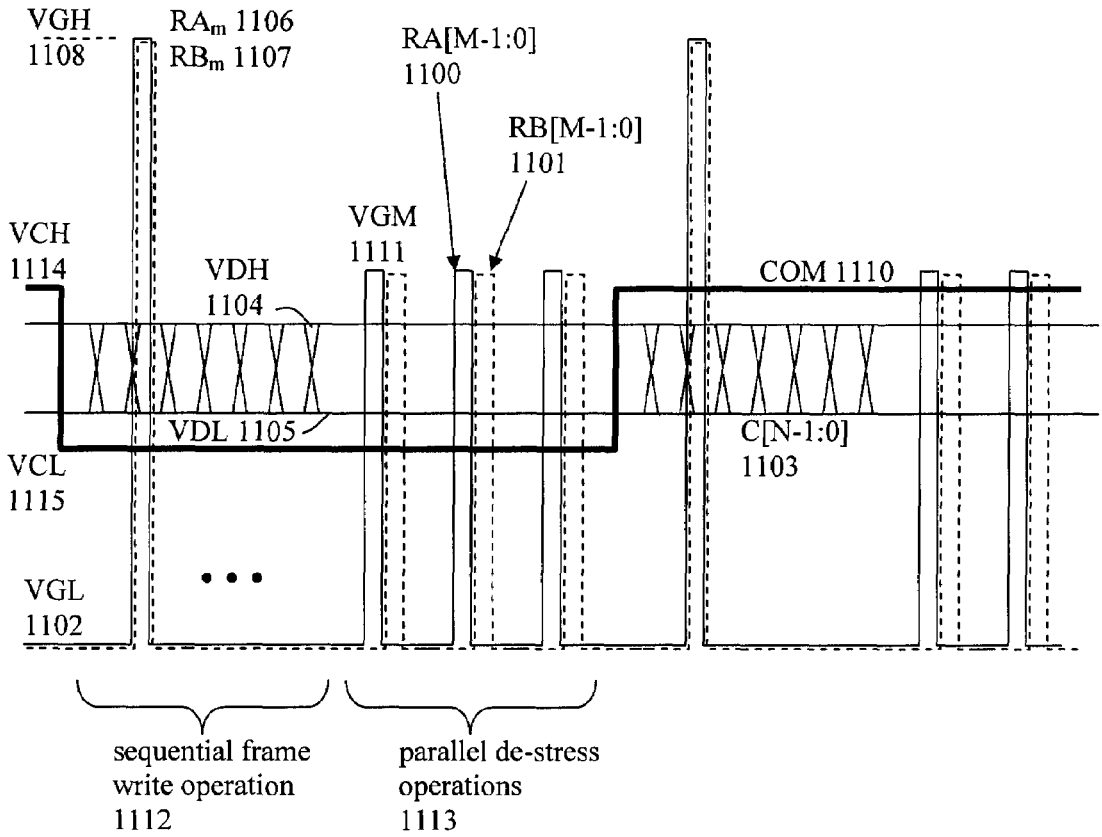
FIG. 11 shows a representative first set of voltage waveforms associated with the operation of the TFT pixel circuit in FIG. 9.
Figure 11:
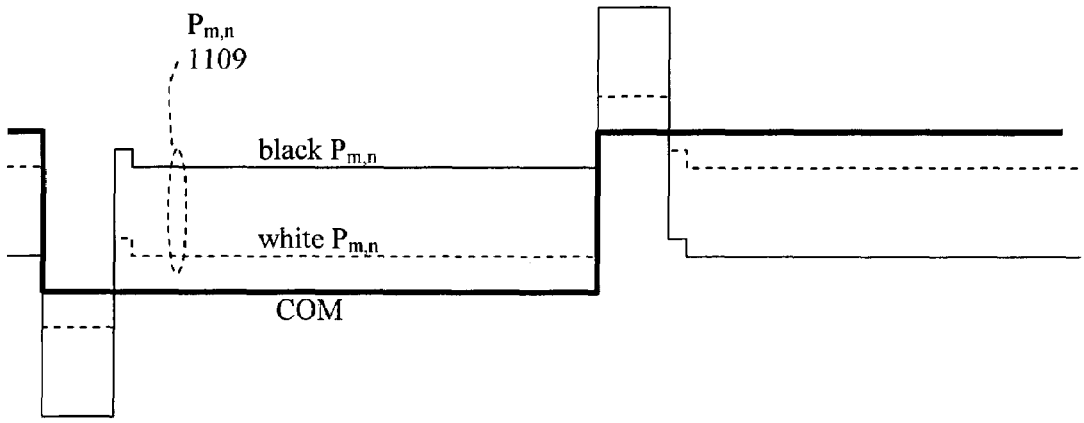

FIG. 11 shows a representative timing diagram for an embodiment of the present invention with a three level row driver. In the panel's initial state, the row lines RA[M-1:0] 1100 and RB[M-1:0] 1101 are held in a low voltage state as to prevent charge leakage from substantially all of the pixel array's charge storage capacitors (i.e. at least one of every pixel's M1 904 or M2 905 TFTs is in an "off" state). Generally this is accomplished by holding all row lines (RA[M-1:0] 1100 and RB[M-1:0] 1101) at a low gate voltage level, VGL 1102.

To perform a frame write operation, the column lines C[N-1:0] 1103 are driven to the desired pixel voltages for a given row of pixels. For the present example, a bi-level column drive waveform using two data voltages, VDH 1104 and VDL 1105 will be used to simplify the description and drawings. Those skilled in the art will recognize that the column lines can be driven with analog voltages between VDH 1104 and VDL 1105 to create a grayscale response in the LCD material. The present teachings can be generally applied to binary, multilevel and/or continuous analog column line drive.

The two or more row select lines for a given row of pixels (e.g. $RA_m$ 1106 and $RB_m$ 1107) are then pulsed from their resting low voltage VGL 1102 to a high voltage VGH 1108 which has the effect of turning "on" all of the M1 904 and M2 905 TFTs in each of the pixels in an entire row of pixels. This selected row of pixels then charges to the voltages driven on the C[N-1:0] 700 800 1103 column lines. Once sufficient time has elapsed for the pixel values $P_{m,n}$ 909 1109 to substantially settle to the C[N-1:0] 1103 voltage levels, the row select lines $RA_m$ 1106 and $RB_m$ 1107 are returned to their resting low potential VGL 1102, turning "off" all of the M1 904 and M2 905 TFTs in the now de-selected row.

In a preferred embodiment, the voltage level VGL 1102 is chosen to be negative enough so that the pixel charge stored on $C_{ST}$ 907 does not substantially leak away through M1 904 or M2 905 between pixel writes or refreshes. The pixel storage capacitors $C_{ST}$ 907 are preferably large enough to prevent pixel charge leakage during non-selected periods and to overcome (to the extent desired by the display designer) the residual image effect that can occur on a pixel gray level transition due to the variable LCD capacitance $C_{LC}$ 906. In this manner the voltage across the LCD pixels can be independently programmed to generate a desired optical state of the array of pixels by controlling the voltages across the liquid crystal cells. Each row of pixels can be similarly loaded to complete the frame as described above. Those skilled in the art will recognize that the exact sequence of the actions taken, e.g. that the rows are processed sequentially, can be modified to achieve a similar end. Such modifications are considered within the scope of the present teachings.

Referring to FIG. 11, the COM electrode 1110 can optionally be driven with an AC waveform to improve cell retention, limit array or source voltage ranges and/or reduce system power as is well known in the art. FIG. 11 specifically gives the example of bi-level modulation between a high value VCH 1114 and a low level VCL 1115. The present teachings regarding low frame rate operation of TFT pixels incorporating negative stress mitigation through gate modulation can be applied by one skilled in the art to the many known methods of COM modulation and/or applied without limitation to the case where COM 1110 is kept at a static DC voltage.

Once the entire array of pixel values is written, the array can be placed in a standby state to conserve power until the array of pixel voltages $P_{m,n}$ 909 leak away enough to require refreshing to prevent image artifacts (e.g. flicker). This standby state between frame image write operations comprises the second phase of the operation of a preferred embodiment. Many applications of flat panels can make use of a variable frame rate; the concepts described herein are well suited to applications where the frame rate must run fast for certain types of content (e.g. 30 Hz frame rate when the user is actively interacting with the device) but also needs a low power state where frame refresh rate can drop to a few Hz. To achieve this, a variable length standby state can be inserted between the active frame writes or refreshes of the first phase described above.

Referring to FIG. 11, in a preferred embodiment of the present invention, during the standby state in between frame write operations, the row gate lines $RA_m$ 1106 and $RB_m$ 1107 for a given row, a subset of rows or all the rows are alternately biased between a "off" state with gate voltage VGL 1102 and a weak "on" state with a gate voltage VGM 1111 which is chosen to preferably achieve a slightly positive $V_{GS}$ across the pixel transistors M1 904 and M2 905. When the pixel is in such a bias state (i.e. either but not both of M1 904 and M2 905 in a weakly "on" state) the pixel charge that was written during the frame write operation is substantially preserved. The application of the weakly "on" gate bias VGM 1111 to a TFT injects any accumulated positive charges (i.e. holes) that arose during the previous "off" state which has the effect of reducing the average charge density in the TFT channel which thus interrupts the negative stress accumulation of the TFT device. This operation of the two pixel TFTs 904 905 in an opposing state (e.g. on/off or off/on) is herein referred to as a de-stress operation and is preferentially performed in sequence with or interleaved with frame or line refreshes to minimize negative bias stress and/or power dissipation of the display. A substantial number of de-stress operations can be inserted between or interleaved within frame refreshes to significantly reduce the negative stress accumulation.

In a preferred embodiment of the present teachings the gate voltages on the pixel transistors M1 904 and M2 905 employ a "break before make" switching transition during the de-stress operation; this ensures that the pixel charge on $C_{ST}$ 907 is well protected against rise/fall time variations and charge leakage at the gate voltage transitions of M1 904 and M2 905.

In a preferred embodiment of the present teachings, all of the RA[M-1:0] 1100 lines in the display are pulsed to VGM 1111 at substantially the same time while the RB[M-1:0] lines 1101 are all held in an "off" state at a negative gate voltage VGL 1102. By pulsing in parallel a large number of row lines, the row driver circuit in the driver IC 603 can be designed to expend less energy using techniques known in the art as charge sharing, stepwise charging, staircase charging or adiabatic charging methods. As a result, the parallel de-stress operation of alternately pulsing all RA[M-1:0] 1100 and RB[M-1:0] 1101 lines can be implemented with substantially better power efficiency compared to sequential switching or pulsing of single gate lines.

By inserting additional AC modulation of the TFT array transistors in excess of the frame write rate, the TFT bias stress is substantially reduced at low frame write rates. Since the energy required to pulse many row lines to a weakly "on" state can be substantially less than that required for a full frame refresh, the power dissipation of the panel as a whole can be reduced significantly without incurring the short lifetime penalty of low frame rate refresh in conventionally scanned TFT displays.

FIG. 11 specifically shows a well differentiated frame write operation 1112 and a number (three) of parallel de-stress operations 1113 between successive frame write operations. Persons skilled in the art will recognize that a wide variety of scanning waveforms that transpose, interleave, group, sequence or otherwise reorder the two basic display drive operations of the present teachings, namely writing a pixel in one operation and subsequently de-stressing the pixel in another operation. The scope of the claims is not limited by such modifications or permutations. In some cases, for example, it may be advantageous to interleave the de-stress and write operations so that a de-stress operation is applied after only a subset of the rows are written. Those skilled in the art will recognize that the exact sequence of the actions taken, e.g. that the rows are processed sequentially, can be modified to achieve a similar end. Some advantageous changes, e.g. writing all even rows first, then all odd rows, and/or partial display refresh can be adapted to the present system to reduce voltage swings and power dissipation by minimizing transitions while performing any number of inversion techniques, including line, column, frame and dot inversion DC balancing. Such modifications and permutations are considered within the scope of the present teachings.

In a preferred embodiment of the present teachings, the voltage levels VGL, VGM and VGH are chosen to obey the following relationship: VGH>VGM>VGL. Persons skilled in the art will recognize that the timing and voltage levels chosen to implement the write process and de-stress process can be adjusted and modified to meet specific engineering requirements; the scope of the claims is not limited by such adjustments and modifications.

Figure 12:
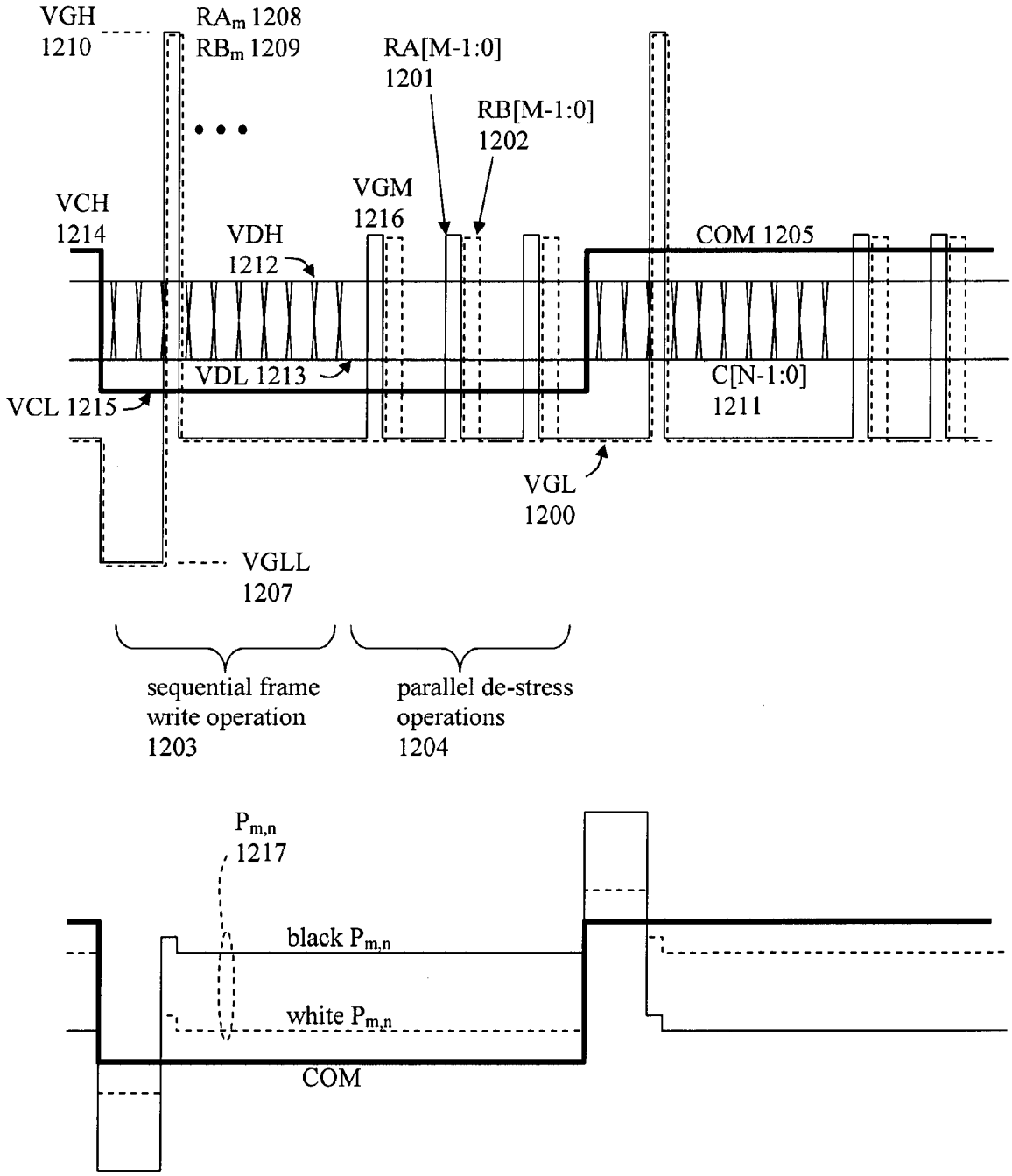
FIG. 12 shows a representative second set of voltage waveforms associated with the operation of the TFT pixel circuit in FIG. 9.

FIG. 12 shows a representative timing diagram of a preferred embodiment of the present teachings similar to that of FIG. 11 except that it utilizes a four level row drive signal with modified DC voltage levels. In comparison with the waveforms of FIG. 11, the low level VGL 1200 of the row signals, RA[M-1:0] 1201 and RB[M-1:0] 1202 has been substantially raised and is applied after a specific row is written during frame write operation 1203 and during the standby state in between de-stress operations 1204. As shown in FIG. 11, starting from the left side, the COM electrode 1205 transitions from VCH 1214 to VCL 1215 to start the new frame write; substantially coincident with the COM 1205 transition, substantially all of the RA[M-1:0] 1201 and RB[M-1:0] 1202 lines are driven with a substantially similar voltage step polarity and magnitude as the COM line 1205 to level VGLL 1207. Since the stored pixel voltages in the array are strongly coupled to COM 1205, the M1 904 and M2 905 gates are kept in an "off" state during this transition. The new frame is then scanned into the pixel array by sequentially pulsing $RA_m$ 1208 and $RB_m$ 1209 lines to VGH 1210 to activate each row of pixels while applying pixel data on column lines C[N-1:0] 1211 in the form of data voltage levels VDH 1212 and VDL 1213. After pulsing to VGH 1210, the row lines $RA_m$ 1208 and $RB_m$ 1209 are brought back to the now raised VGL 1200 level. Once all of the lines are scanned and the frame is loaded (i.e. written or refreshed), all of the row lines will have been returned to the VGL 1200 level. De-stress operations that switch the two sets of RA[M-1:0] 1201 and RB[M-1:0] 1202 row lines alternately between VGL 1200 and VGM 1216 are then inserted between frame write operations as in FIG. 11. When the COM 1205 is transitioned upward for the subsequent frame to VCH 1214, the row lines RA[M-1:0] 1201 and RB[M-1:0] 1202 are preferentially held at VGL 1200 as shown in FIG. 12.

By transitioning all of the row lines from VGL 1200 to VGLL 1207 in concert with the COM 1205 transition to VCL 1215, the negative stress on the M1 904 and M2 905 TFTs is minimized. The leakage conduction in row ESD circuits, e.g. 608 710 810 812, is also minimized by keeping the voltage difference between the row signals RA[M-1:0] 1201, RB[M-1:0] 1202 and COM 1205 low. Note that the waveform of pixel voltage $P_{m,n}$ 1217 is substantially unchanged from that of FIG. 11 $P_{m,n}$ 1109 despite the lower amplitude row signals. By applying a four level row drive, the row voltage excursions from the COM level can be minimized in a COM modulation technique to minimize ESD leakage power.

In a preferred embodiment of the present invention, the four levels used for the row driver (VGH, VGM, VGL and VGLL) obey the following relationship: VGH>VGM>VGL>VGLL. In a preferred embodiment of the present invention the two levels of the column driver (VDH and VDL) and the two levels of the COM driver (VCH and VCL) obey the following relationship: VCH>VDH>VDL>VCL. In a preferred embodiment, the row voltages and column voltages obey the following relationship: VGH>VDH>VDL>VGL.

In an additional embodiment (not shown), the transition in the gate line voltages when COM transitions can be implemented by floating the row lines prior to the COM transition. Since the row gate lines are strongly coupled to COM, they will substantially follow the COM step with the desired amplitude and polarity. Additionally when integrated a-Si row drivers are used, the output of the row driver can be disconnected after the last de-stress operation and only reconnected upon selection during the frame write when the selected row is driven to VGH then VGL. In this fashion the waveforms of FIG. 12 can be naturally implemented with a floating row line drive technique, e.g. in a display implementing an integrated row driver circuit made of a-Si TFTs that does not have a high duty cycle pull down device on the row lines.

Figure 13:
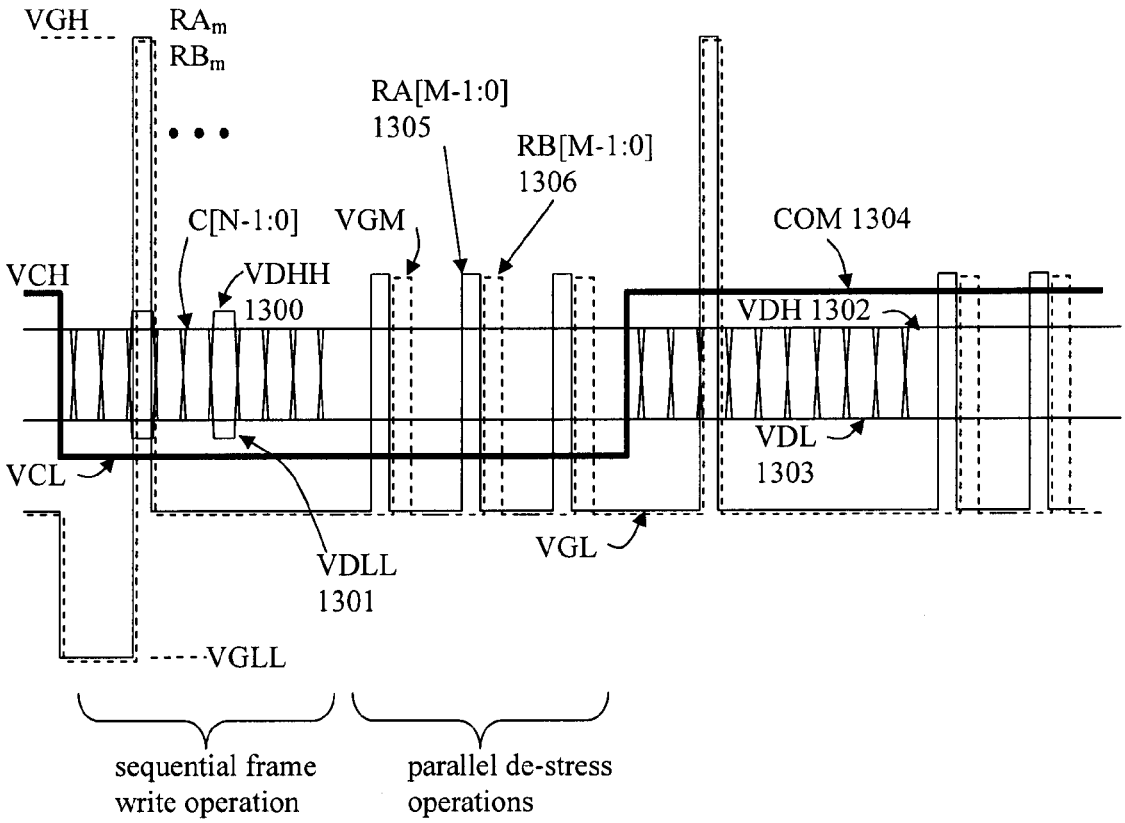
FIG. 13 shows a representative third set of voltage waveforms associated with the operation of the TFT pixel circuit in FIG. 9.
Figure 13:
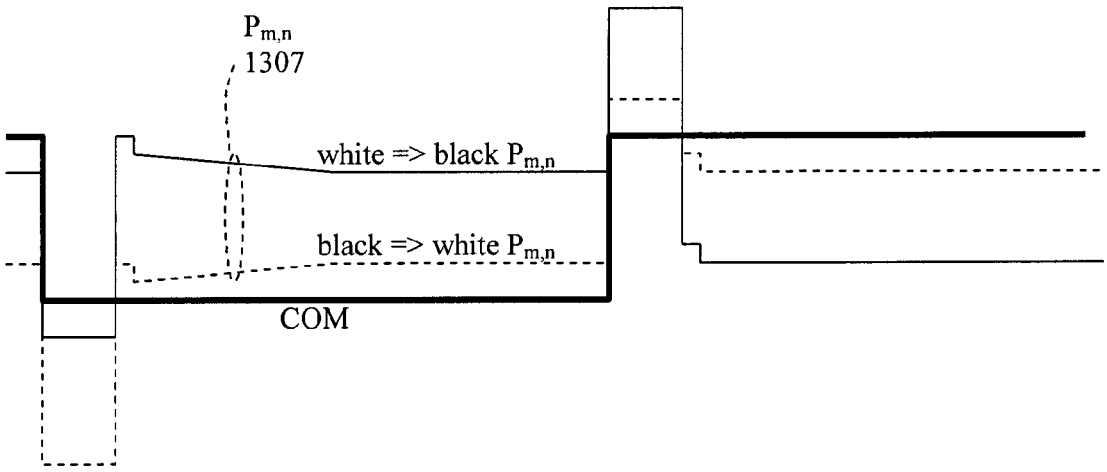

FIG. 13 shows a representative timing diagram of a preferred embodiment of the present teachings consisting of a four level row drive signal and a four level column drive signal. The operation of the COM signal 1304 and row signals RA[M-1:0] 1305 and RB[M-1:0] 1306 is identical to the description given for FIG. 12. Comparing FIGS. 12 and 13, FIG. 13 has two additional voltage levels available for the column driver, VDHH 1300 and VDLL 1301. These voltages are preferentially driven onto the column lines during the frame write operation when the desired pixel is transitioning from the opposite state (e.g. white to black or black to white). The voltage levels VDHH 1300 and VDLL 1301 preferentially sit outside the normal range of column source voltage (VDH 1302 and VDL 1303) and are chosen to compensate for the time-varying capacitance of the liquid crystal upon an optical state change. As is well known in the art, overdrive of the pixel on a state change can allow the pixel voltage to settle to a more desirable final value (e.g. to the values achieved by static pixels written repeatedly to VDH 1302 or VDL 1303) within the first frame. The bottom waveforms of FIG. 13 show a the pixel voltage $P_{m,n}$ 1307 being overdriven by the initial VDHH 1300 or VDLL 1301 levels but relaxing to the desired VDH 1302 or VDL 1303 cell voltage levels as the LC material slowly responds to the new optical state. Such overdrive techniques that can mitigate residual image or image sticking problems can optionally be applied to the present teachings without limiting the present claims.

In a preferred embodiment of the present invention represented in the waveforms of FIG. 13, the four levels of the column driver (VDHH, VDH, VDL and VDLL) obey the following relationship: VDHH>VDH>VDL>VDLL. The choice of voltage levels for each of the four column levels described in FIG. 13 can be similarly modified to share levels with other voltages available in the system (e.g. VCH, VCL) to reduce the number of independent power supplies required by the display. The scope of the claims is not limited by such choices or optimizations.

Figure 14:
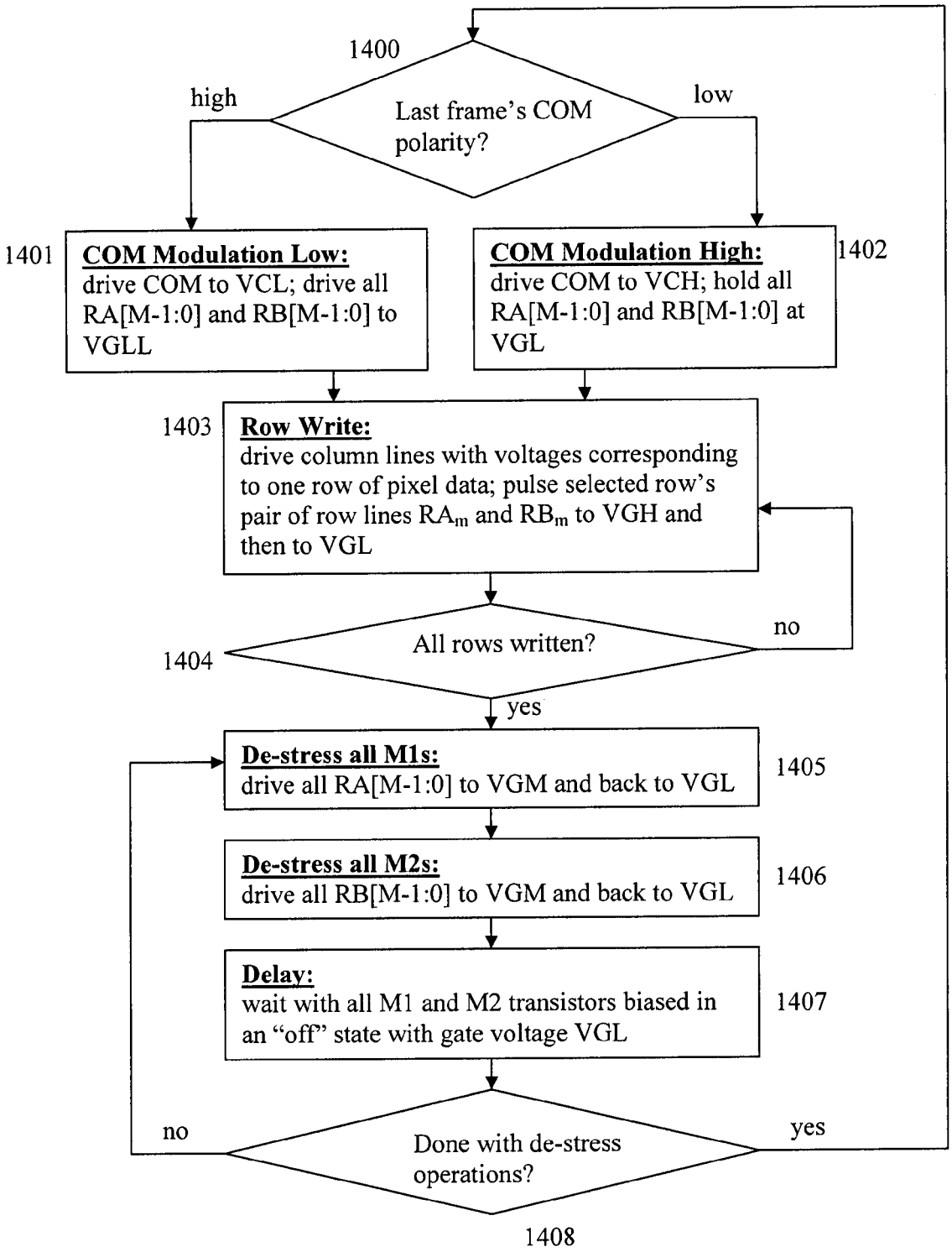
FIG. 14 shows a representative flow chart indicating the operations of the TFT LCD.

FIG. 14 shows the operational flow chart of this embodiment. Starting from the top of FIG. 14, the first decision process 1400 determines the polarity the present frame. If the last frame polarity was with COM=low, the COM modulation high operation 1402 is performed wherein COM is driven to VCH and all of the row lines RA[M-1:0] and RB[M-1:0] held at VGL. If the last frame polarity was with COM=high, the COM modulation low operation 1401 is performed wherein COM is driven to VCL and all of the row lines RA[M-1:0] and RB[M-1:0] are driven to VGLL. Next, a row write operation 1403 comprises driving the C[N-1:0] column lines to the desired pixel voltages or desired overdriven pixel voltages for a given row, driving a selected pair of row lines $RA_m$ and $RB_m$ to VGH to capture the column voltages into a selected row of pixel storage capacitors and finally returning the selected pair of row lines to VGL. A decision process 1404 implements a loop with row write operation 1403 wherein upon exit all of the rows have been written with the selected polarity pixel voltages. Note that midway through the frame write sequence of the COM=low frame (i.e. the loop of row writes formed by 1403 and 1404), some fraction of row lines RA[M-1:0] and RB[M-1:0] will be at VGL and the balance will be at VGLL.

Next, the first de-stress operation 1405 applies VGM to all RA[M-1:0] signals then returns RA[M-1:0] to VGL followed by the second de-stress operation 1406 which applies VGM to all RB[M-1:0] signals then returns RB[M-1:0] to VGL. A delay operation 1407 wherein all of RA[M-1:0] and RB[M-1:0] are held at VGL completes the three phase de-stress operation (i.e. the combination of steps 1405, 1406 and 1407). Note that the sequence of events (de-stress all M1s first by pulsing RA[M-1:0], then all M2s by pulsing RB[M-1:0], then delay) can be arbitrarily sequenced, reordered, spliced with additional delays, repeated, exited at any operation, and/or interleaved within the scope of the present teachings. For example, de-stressing the RB[M-1:0] signals can be done first. In another example, the frame write operation can be broken up into one or more sections (partial frame updates of one or more rows) that are then interleaved with de-stress operations and/or delays. In an additional embodiment (not shown) portions of the pixel frame can remain undriven (frame write operation only updates part of the frame) to conserve additional energy as well. Such implementation decisions are compatible with the present teachings and can benefit from the stress mitigation and low power techniques embodied herein.

Referring again to FIG. 14, once the desired number of de-stress operations has been completed, the final decision process 1408 exits the de-stress loop formed by 1405, 1406, 1407 and 1408 and returns to the first decision process 1400 to start a subsequent opposite polarity frame.

The waveforms and operations described in FIGS. 11 through 14 can be synthesized using a variety of well know techniques. In a preferred embodiment, DC voltage sources and switch based multiplexors are controlled digitally to generate the multilevel waveforms of FIGS. 11 through 13. For example, the row waveforms of FIG. 11 use a three level row driver that selects between VGL, VGM and VGH. For the column waveforms of FIGS. 11 and 12, a two level analog mux is required that selects between VDH and VDL DC levels. Similarly COM requires a two level mux that selects between VCH and VCL.

One skilled in the art will recognize a number of different generation mechanisms including DACs followed by buffer amplifiers, bootstrapped charge pumps, alternate demultiplexing circuits, etc. that can be used to synthesize similar waveforms. Such alternate waveform synthesis methods are well known in the art and can be substituted without impacting the utility of the present teachings.

Figure 15:
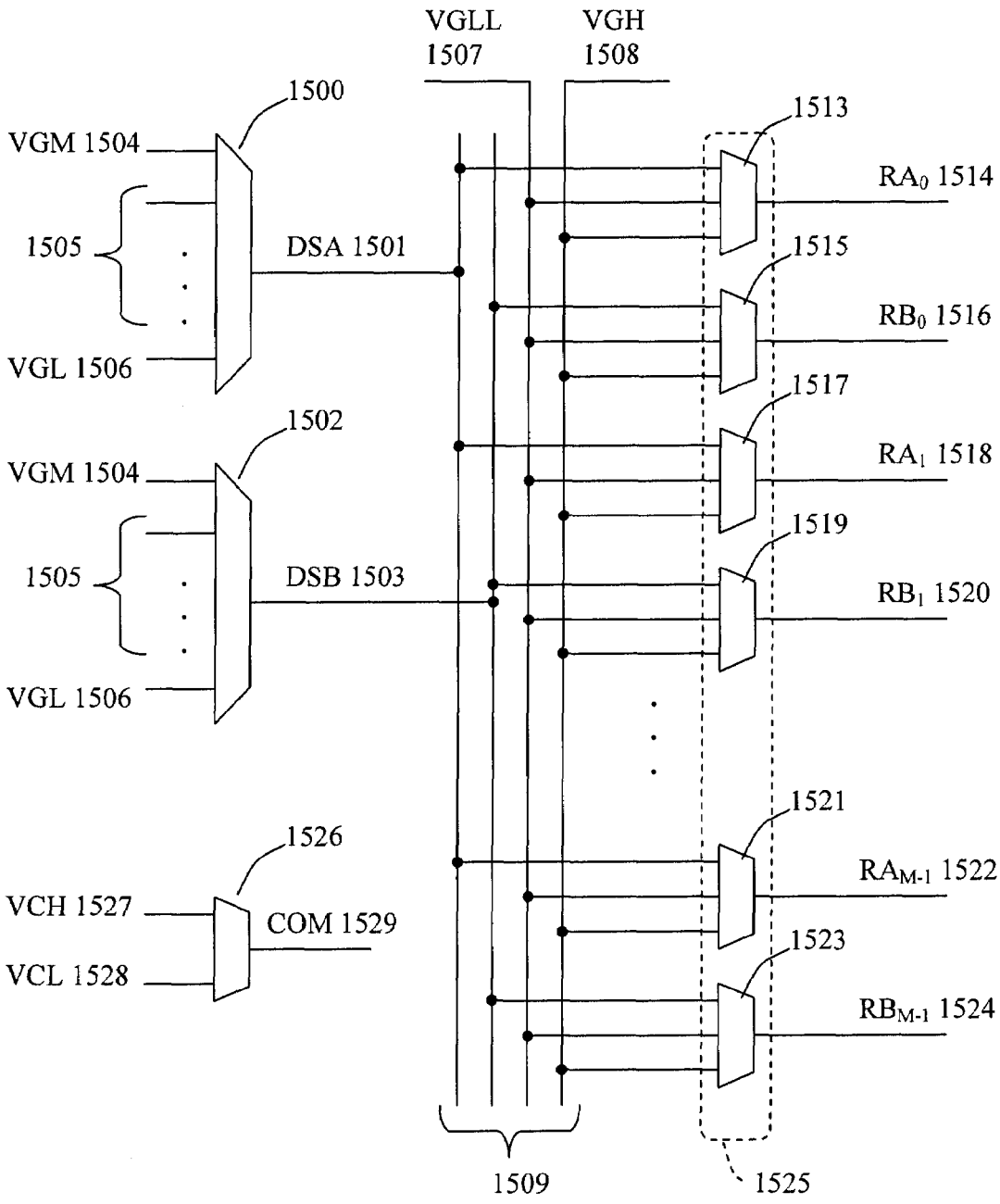
FIG. 15 shows a representative output multiplexer of a row driver circuit for generating the waveforms of FIGS. 12 and 13.

FIG. 15 shows a preferred embodiment of the present teachings incorporating a hierarchical multiplexer arrangement that improves power efficiency during de-stress operations. Source mux 1500 generates an intermediate signal DSA 1501 and source mux 1502 generates an intermediate signal DSB 1503 by selecting from the desired endpoint de-stress DC levels VGM 1504 and VGL 1506 as well as any number of intermediate voltage levels 1505. The COM mux 1526 generates the COM signal 1529 by selecting between VCH 1527 and VCL 1528. The intermediate signals DSA 1501 and DSB 1503 as well as two other DC levels, VGH 1508 and VGLL 1507, form a bus 1509 that is connected to a large number (e.g. 2M where M=number of pixel rows) of three-to-one output muxes 1525 that in turn drive the row signals of the TFT display pixel array 602 and row line ESD circuits 608.

Referring to FIG. 15, prior to a frame write operation, all of the row outputs RA[M-1:0] and RB[M-1:0] (e.g. $RA_0$ 1514, $RB_0$ 1516, $RA_1$ 1518, $RB_1$ 1520 through $RA_{M-1}$ 1522 and $RB_{M-1}$ 1524) are attached through their respective muxes to either DSA 1501 or DSB 1503 which in turn are connected to VGL 1506 by muxes 1500 and 1502. If the new frame is with COM=VCH, 1527 then the row output muxes 1525 continue to select either DSA 1501 or DSB 1503. However if the frame polarity requires COM=VCL 1528 then the row output muxes are driven to select VGLL 1507 as the output. Thus for the COM=VCL 1528 polarity frame all the rows RA[M-1:0] and RB[M-1:0] are driven to VGLL 1507 in concert with the transition on COM 1529 as shown in FIGS. 12 and 13.

Referring again to FIG. 15 specifically and FIGS. 12 through 14 generally, the next operation is the row-by-row writing of the frame which comprises sequential pulsing of pairs of row lines, e.g. $RA_0$ 1514 and $RB_0$, to a high level VGH 1508. Once a pair of row lines (e.g. $RA_0$ 1514 and $RB_0$ 1516) has been pulsed to VGH 1508 to write that specific row of pixels, the selected pair of $RA_m$ and $RB_m$ signals are then connected to DSA 1501 and DSB 1503 respectively through the appropriate output mux 1525. DSA 1501 and DSB 1503 are in turn held at VGL 1506 by muxes 1500 and 1502 so that the now de-selected row lines $RA_m$ and $RB_m$ are driven to VGL 1506. Once the entire frame has been written, none of the muxes 1525 remain attached to VGH 1508 or VGLL 1507; all have transitioned to either DSA 1501 or DSB 1503 (and therefore voltage level VGL 1506) in preparation for the de-stress operation.

Referring again to FIG. 15 specifically and FIGS. 12 through 14 generally, the frame write operation is followed by one or more de-stress operations which start with all of the output muxes 1525 selected so that the output row lines RA[M-1:0] are attached to DSA 1501 and that the output row lines RB[M-1:0] are attached to DSB 1503. When a de-stress operation is performed, in the case where the RA[M-1:0] lines are de-stressed first, the mux 1500 is digitally driven to sequentially select progressively increasing voltages from VGL 1506, through the intermediate levels 1505 until reaching VGM 1504. By driving the row driver outputs in small increments by selecting sequentially and progressively from a set of efficiently generated intermediate power supplies 1505, the dissipated power of the circuit can be substantially reduced, ideally by 1/(Q+1) where Q is the number of intermediate levels 1505. Since the de-stress operations preferentially drive the entire display (e.g. all RA[M-1:0] are driven at the same time) the capacitive load seen on DSA 1501 or DSB 1503 can be quite high (M row capacitances in parallel). Furthermore, the de-stress operations do not preferentially have very stringent requirements for rise and fall times. Both of these factors (large capacitive load, rise/fall time not critical) make possible a fine-grain adiabatic or step-wise driving method to save substantial power. Note the intermediate power supplies should be generated as efficiently as possible to maximize the power savings.

Figure 16:
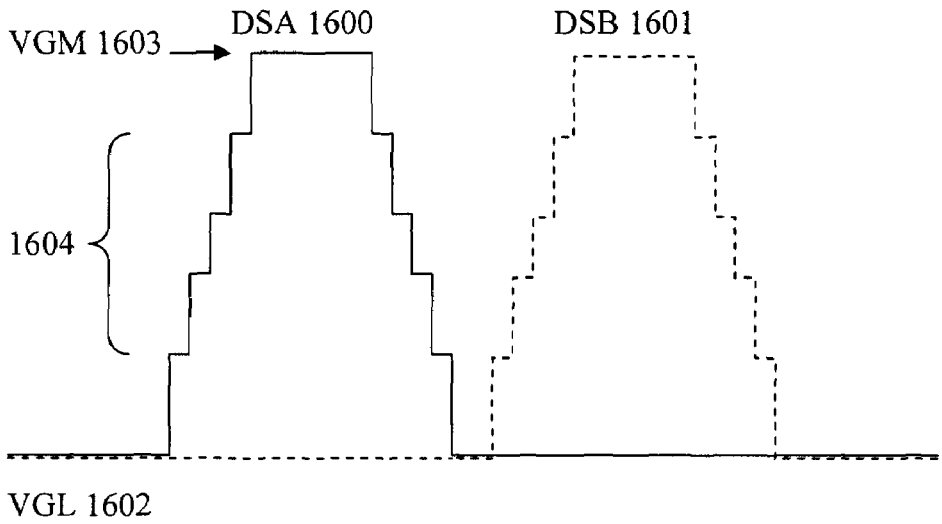
FIG. 16 shows a representative step-wise charging of two internal signals of a row driver circuit.

FIG. 16 shows a representative step-wise driving of DSA 1501 1600 and DSB 1503 1601 from a starting low level VGL 1602 to a high level VGM 1603 stepping at a number of efficiently generated intermediate power supply voltages 1604.

Figure 17:
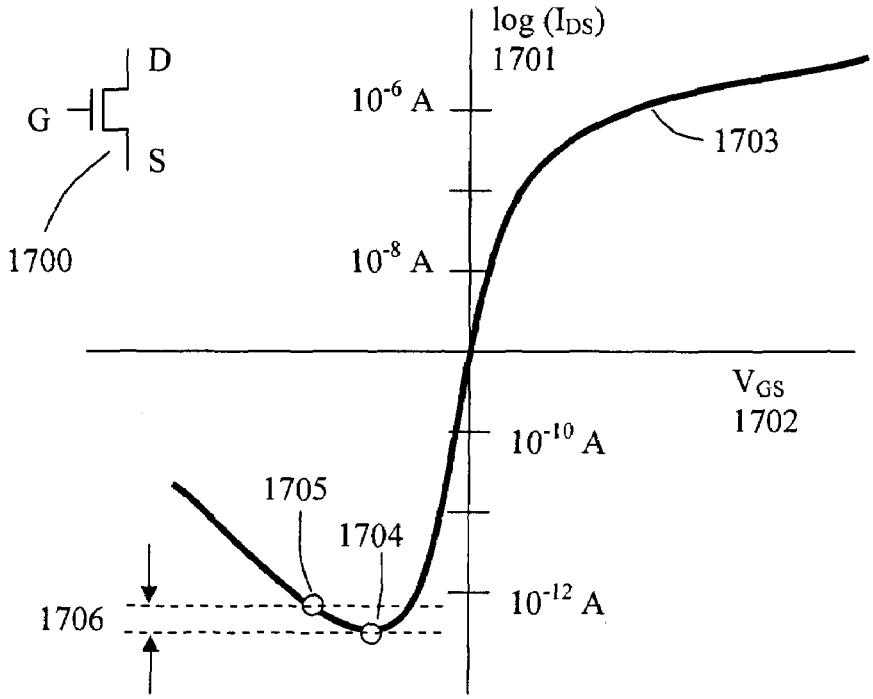
FIG. 17 shows a representative transfer function for a thin film transistor (TFT).

FIG. 17 shows a representative transfer curve of a TFT device 1700 with source (S), gate (G) and drain (D) terminals at the upper end of the operating temperature range. As the voltage between the gate (G) and source (S) ($V_{GS}$ 1702) is increased from very negative on the left, the drain-source current ($I_{DS}$ 1701) first falls then rises rapidly around $V_{GS}=0$ (following curve 1703) and finally saturates at high positive $V_{GS}$ 1702. There is often an optimum $V_{GS}$ 1702 voltage at which the "off" conduction is minimized, e.g. 1704.

Reviewing the waveforms of FIG. 11, it can be seen that in the case where row line resting voltage during de-stress (i.e. VGL 1102), the voltage of the CS lines (VDH 1104 and VDL 1105) and the voltage on the pixels (Pm,n 1109, in the range of VDH 1104 and VDL 1105) creates a more negative $V_{GS}$ operating point 1705 than the ideal operating point 1704. This is because VGL 1102 in the drive scheme of FIG. 11 must be chosen that it is low enough to prevent the pixel TFTs from turning partially "on" when COM 1110 transitions to VCL 1115 (pixel voltages $P_{m,n}$ 1109 are capacitively driven lower by COM and the gate lines of the pixel transistors must be low enough to prevent conduction). But such a low gate level, when applied continuously as the resting state for row lines between other operations, creates non-optimum leakage conduction (e.g. operating point 1705) in the pixel TFTs. For example a 50% increase in leakage current (e.g. the difference 1706 between operating points 1704 and 1705) will have the undesirable effect of causing the stored pixel voltages, $P^{m,n}$ 1109, to leak away 50% faster than they otherwise could (i.e. if they were at optimal $V_{GS}$ 1702 point 1704). To compensate, the frame rates and storage capacitor sizes must be increased which will adversely affect power. Furthermore, since the low gate voltage VGL 1102 in FIG. 11 is substantially different from COM 1110 (especially in the COM=VCH 1114 frame polarity) the power dissipation in the ESD structures, e.g. 608 710 810 812, which provide a nonlinear conduction path from row lines to COM 1110 can become prohibitive.

In contrast, the waveforms of FIGS. 12 and 13, the flow diagram of FIG. 14 and the multiplex based driver IC circuit of FIG. 15 circumvent this limitation by introducing a four level row waveform that keeps the $V_{GS}$ 1702 of the pixel array at or near the optimum operating point 1704 for the majority of either polarity frame. This allows further reduction in frame rate and/or storage capacitance to save additional power. Furthermore, since the row signals of FIGS. 12 and 13 are driven with less voltage difference to COM, the ESD structure leakage power (which is highly nonlinear in voltage) is also substantially reduced.

Additionally, since the channel charge accumulation rate is slowest at the optimum "off" $V_{GS}$ 1704 (i.e. charge carriers, e.g. holes, accumulate more slowly at operating point 1704 versus operating point 1705), the frequency dependence of the negative stress on the pixels shifted lower using the waveforms of FIGS. 12 and 13, allowing frame write operation rate and de-stress operation rate to be further reduced saving additional power. Also, since the magnitude of the negative $V_{GS}$ during the "off" time in FIGS. 12 and 13 is reduced, the power-law dependence on voltage of the negative bias stress accumulation is minimized as well. Thus the present teachings provide substantial improvements in both display module power and device reliability.

Figure 18:
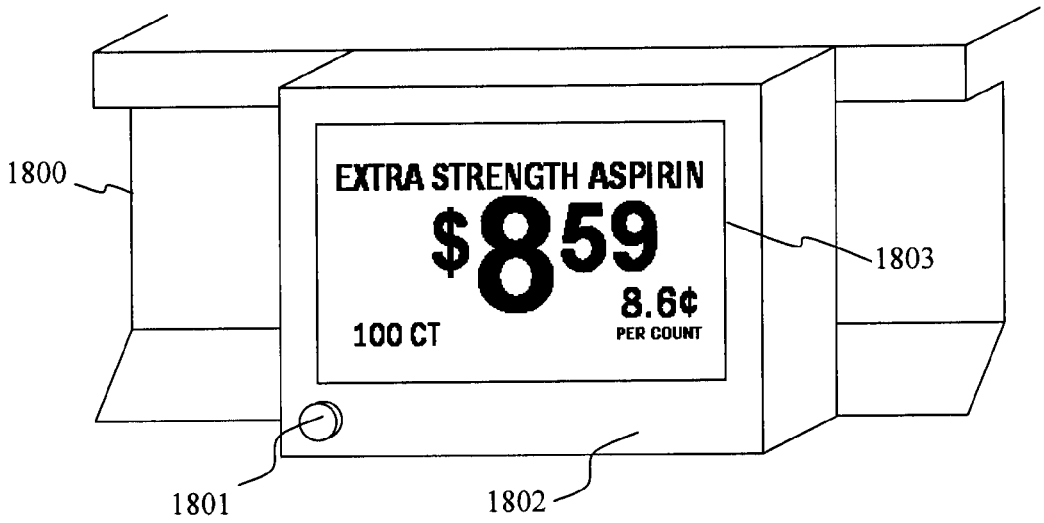
FIG. 18 shows a representative electronic shelf label with a display.

FIG. 18 shows an electronic shelf label 1802 integrating the flat panel display 1803 of the present teachings into a device that can be attached to a store shelf 1800 to display product information and pricing. An interactive button 1801 can be used to provide additional information to store personnel or shoppers.

Figure 19:
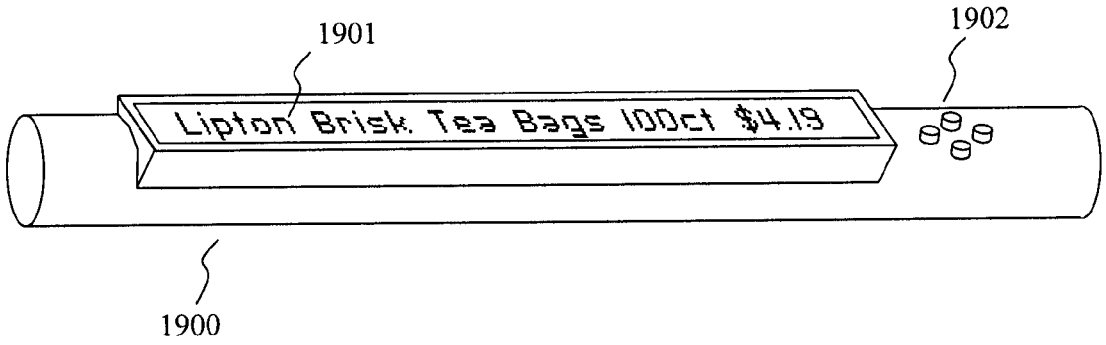
FIG. 19 shows a representative electronic shopping cart handlebar with a display.

FIG. 19 shows a shopping cart handlebar mounted display utilizing the present teachings. A display 1901 is attached to a shopping cart handlebar 1900. One or more buttons or a keypad 1902 allows for user input.

Figure 20:
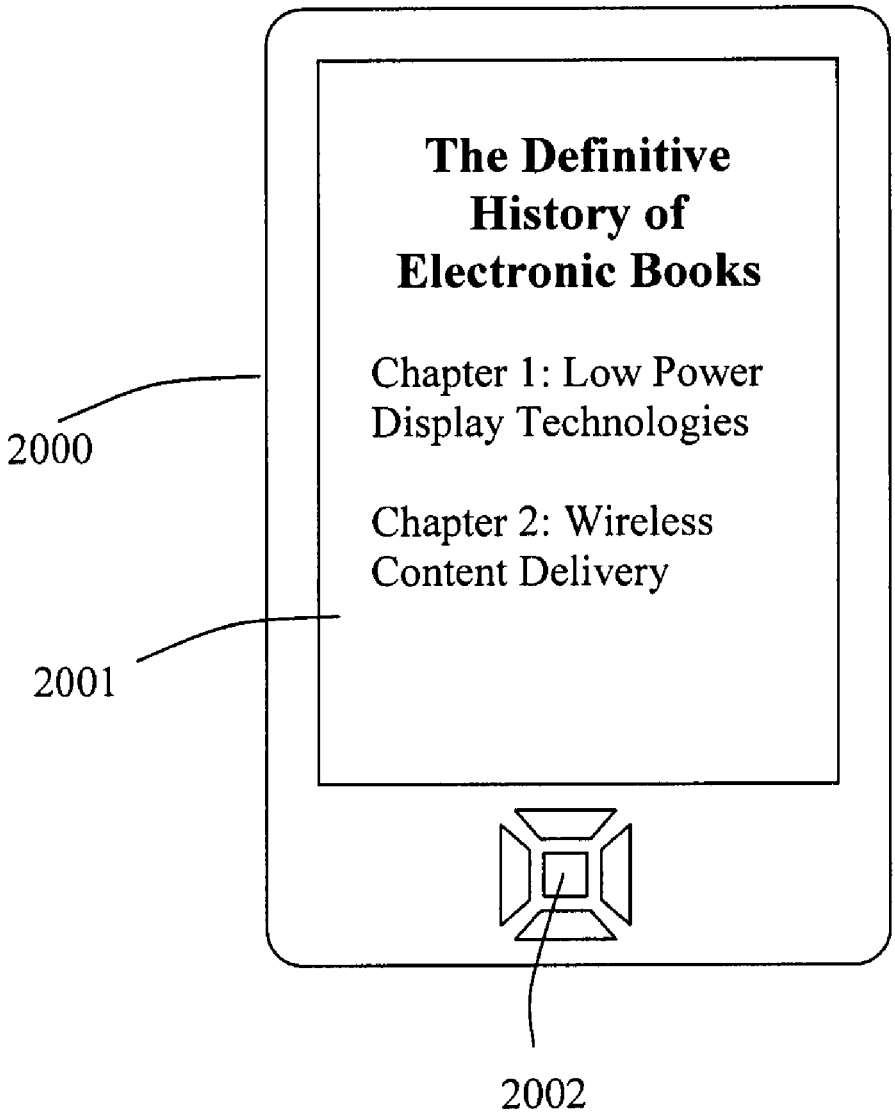
FIG. 20 shows a representative electronic book with a display.

FIG. 20 shows an electronic book design utilizing the present teachings. The electronic book 2000 is comprised of a low power screen 2001 and a navigation keypad 2002.

Figure 21:
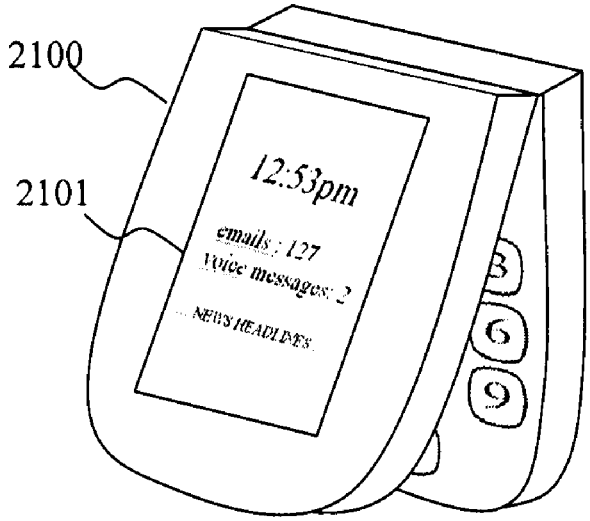
FIG. 21 shows a representative cell phone with a display.

FIG. 21 shows a clamshell cell phone design utilizing the present teachings. A low power reflective outer screen 2101 is integrated into the lid of the cell phone 2100.

Figure 22:
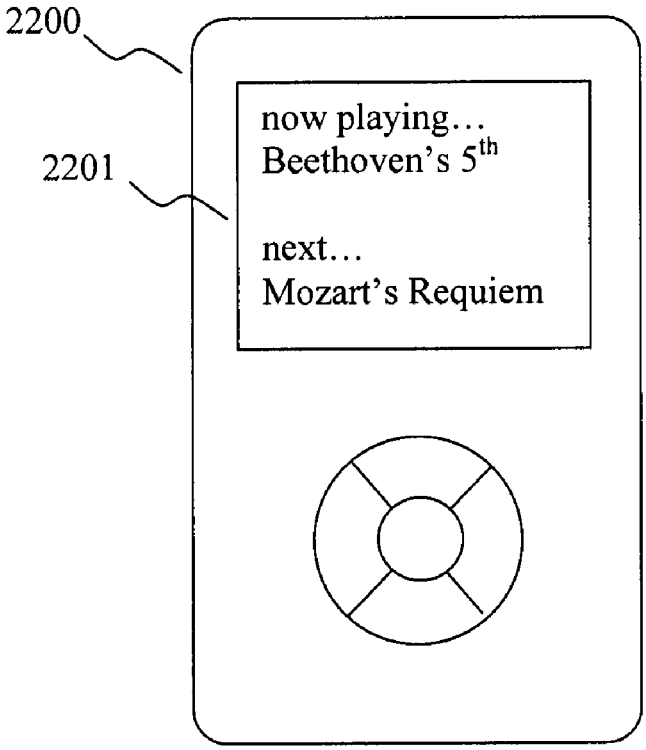
FIG. 22 shows a representative portable music player with a display.

FIG. 22 shows a portable digital music player 2200 integrating a display 2201 based on the present teachings.

Figure 23:
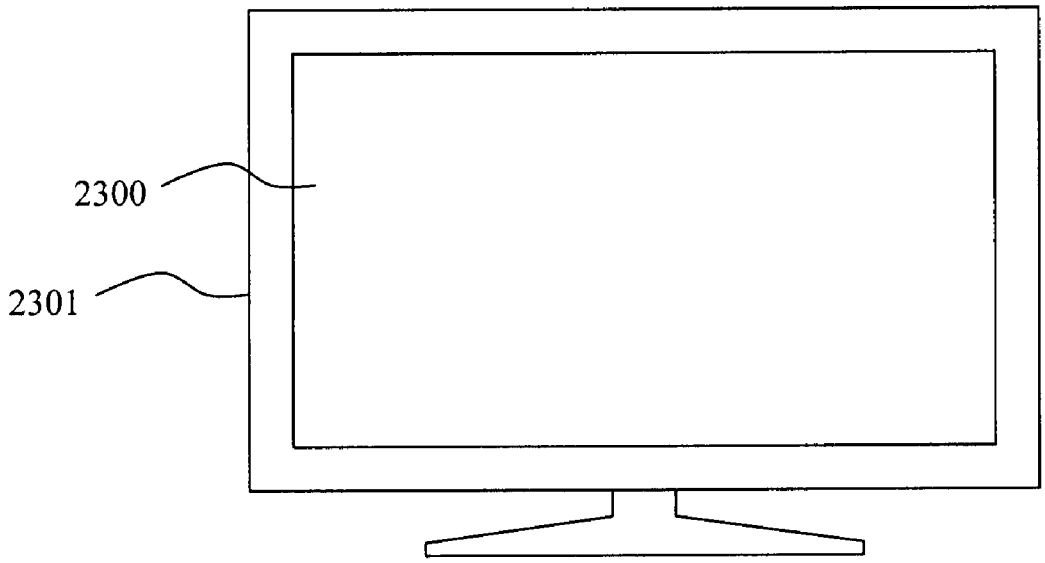
FIG. 23 shows a representative flat panel TV, monitor or digital signage with a display.

FIG. 23 shows a computer monitor, promotional signage or television 2301 with a display 2300 based on the present teachings.

Figure 24:
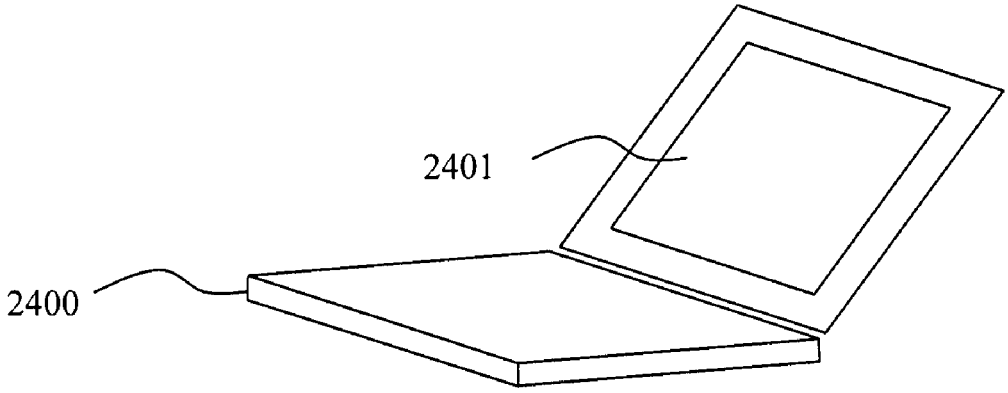
FIG. 24 shows a representative notebook computer, digital picture frame or portable DVD player with a display.

FIG. 24 shows a portable computer, digital picture frame or portable DVD player 2400 with a display 2401 based on the present teachings. Such a screen 2401 based on the present teachings can be integrated inside or outside the clamshell (not shown) or the design can be without a hinge (not shown).

Figure 25:
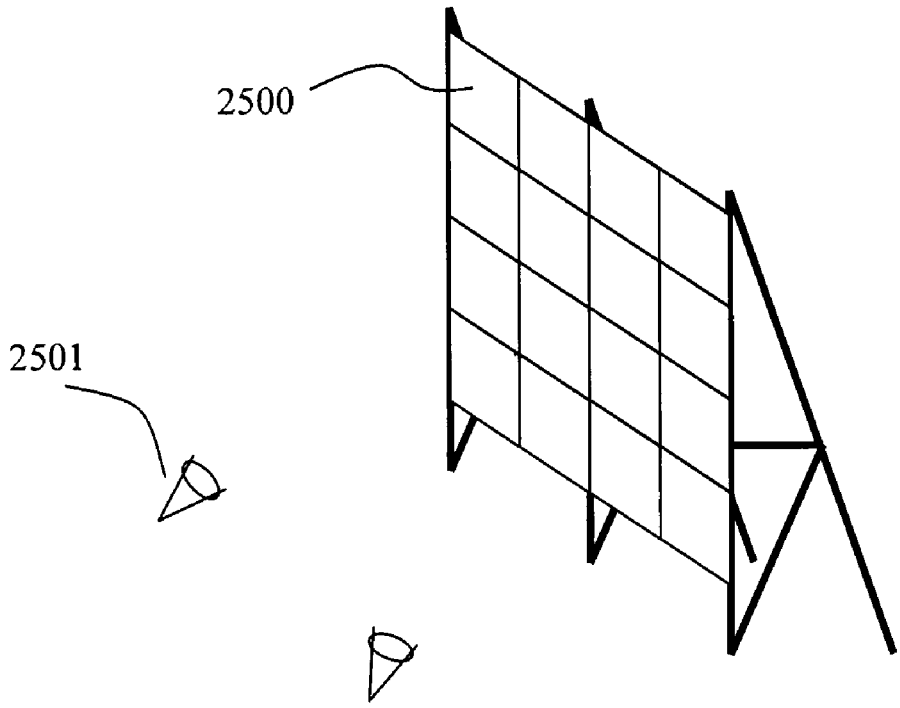
FIG. 25 shows a representative digital billboard with one or more displays.

FIG. 25 shows an outdoor or indoor digital billboard comprised of one or more sub-displays 2500 utilizing the present teachings. Optional front lights 2501 provide sufficient illumination for nighttime readability.

The invention claimed is:

1. A method of operating a display circuit, the display circuit comprising a plurality of active matrix pixels connected to a common electrode and to a row driver circuit through a plurality of row signals, the method comprising:

modulating the common electrode;

writing a plurality of charges to the active matrix pixels; and modulating substantially all of the row signals with substantially the same polarity and amplitude as one or more modulations of the common electrode to substantially preserve the active matrix pixel charges and reduce power loss in the row driver circuit.

2. The method of claim 1, further comprising modulating substantially all of the row signals with substantially the same polarity and amplitude as a negative modulation of the common electrode.

3. A display circuit for a pixel array, comprising:

a row and column driver; and a plurality of pixel circuits coupled to the row and column driver, wherein each pixel circuit comprises at least two transistors in series connected to a pixel of a Liquid Crystal Display (LCD);

wherein the row and column driver is configured to write a new frame onto the LCD by applying first negative gate voltages and positive gate voltages to the transistors of the pixel circuits to form conduction paths to the pixels of the LCD and sending charges to the pixels through the conduction paths, and between frame write operations, for each pixel circuit, applying second negative gate voltages which are higher than said first negative gate voltages.

4. The display circuit of claim 3, wherein the row driver is configured to apply the positive gate voltage to fewer than all of the transistors of the pixel circuit at a rate greater than the frame write operation rate.

5. The display circuit of claim 3, wherein the row and column driver is configured to update the frame of the LCD at a rate of 10 Hz or slower.

6. The display circuit of claim 3, wherein the row and column driver is configured to update the frame of the LCD at a rate of 1 Hz or slower.

7. The display circuit of claim 3, wherein the transistors comprise amorphous silicon hydrogenated thin film transistors (a-Si:H TFTs).

8. A method of operating a display circuit, the display circuit comprising a plurality of transistors connected to pixels of a Liquid Crystal Display (LCD), the method comprising:

performing frame write operations, wherein each frame write operation updates a display image of the LCD, and comprises applying gate voltages to the transistors to program the pixels of the LCD;

modulating said gate voltages during the frame write operations to substantially maintain charge on the pixels of the LCD; and between frame write operations, applying gate voltage modulations to the transistors of the display circuit to keep the transistor channels substantially free of electronic charge.

* * * * *